US011218791B2

(12) United States Patent
Kato

(10) Patent No.: US 11,218,791 B2
(45) Date of Patent: Jan. 4, 2022

(54) HEADPHONE

(71) Applicant: AlphaTheta Corporation, Yokohama (JP)

(72) Inventor: Ryuichi Kato, Yokohama (JP)

(73) Assignee: ALPHATHETA CORPORATION, Yokohama (JP)

( * ) Notice: Subject to any disclaimer, the term of this patent is extended or adjusted under 35 U.S.C. 154(b) by 100 days.

(21) Appl. No.: 16/479,645

(22) PCT Filed: Jan. 27, 2017

(86) PCT No.: PCT/JP2017/003042
§ 371 (c)(1),
(2) Date: Jul. 22, 2019

(87) PCT Pub. No.: WO2018/138891
PCT Pub. Date: Aug. 2, 2018

(65) Prior Publication Data

US 2021/0067856 A1 Mar. 4, 2021

(51) Int. Cl.
*H04R 1/10* (2006.01)
*H04R 5/033* (2006.01)

(52) U.S. Cl.
CPC ..... *H04R 1/1008* (2013.01); *H04R 5/033* (2013.01); *H04R 1/1066* (2013.01); *H04R 5/0335* (2013.01)

(58) Field of Classification Search
CPC .... H04R 1/1008; H04R 1/1066; H04R 5/033; H04R 5/0335
See application file for complete search history.

(56) References Cited

U.S. PATENT DOCUMENTS 5,293,647 A * 3/1994 Mirmilshteyn ..... H04R 1/10 2/209
2011/0116674 A1* 5/2011 Asakura ..... H04R 1/1066 381/378
2019/0222913 A1* 7/2019 Leclerc ..... H04R 1/1008

FOREIGN PATENT DOCUMENTS

GN 106028205 A 10/2016
JP 59-33386 U 3/1984
JP 2005-094603 4/2005
JP 2008-205585 9/2008
JP 2010-239200 10/2010
JP 2010239200 A * 10/2010 ..... H04R 1/10
JP 2013-172371 9/2013
(Continued)

OTHER PUBLICATIONS

International Search Report, dated Apr. 18, 2017 (dated Apr. 17, 2018), 2 pages.

(Continued)

*Primary Examiner* — Oyesola C Ojo
(74) *Attorney, Agent, or Firm* — Rankin, Hill & Clark LLP

(57) ABSTRACT

A headphone includes: a headband; a sound emitter having a sound-emitting unit therein; and a connector connecting the sound emitter to the headband. The connector includes: a support for supporting the sound emitter so that the sound emitter is rotatable in a predetermined rotation range including a reference position; a restoring portion for applying a restoring force on the sound emitter for urging the sound emitter to return to the reference position; and a switcher for switching a state in which the restoring force acts on the sound emitter and a state in which the restoring force does not act on the sound emitter.

13 Claims, 29 Drawing Sheets

(56) References Cited

FOREIGN PATENT DOCUMENTS

| | | | | | |
|---|---|---|---|---|---|
| JP | 2015-026948 | | | 2/2015 | |
| JP | 2015-027102 | | | 2/2015 | |
| JP | 2015-192288 | | | 11/2015 | |
| JP | 2015192288 | A | * | 11/2015 | ..... H04R 1/10 |
| JP | 2016-005058 | | | 1/2016 | |

OTHER PUBLICATIONS

English translation of International Preliminary Report on Patentability dated Jul. 30, 2019 (dated Jul. 30, 2019), Application No. PCT/JP2017/003042, 6 pages.
Japanese Office Action dated Feb. 25, 2020 with English translation, 7 pages.

* cited by examiner

HEADPHONE

TECHNICAL FIELD

The present invention relates to a headphone.

BACKGROUND ART

A known typical headphone is worn on the user's head, covering the user's right and left ears. A known example of such a headphone includes: a pair of housings being placed on the right and left ears; a headband being placed on the head; and connectors provided to ends of the headband, the housings each being rotatably connected to corresponding one of the connectors (see, for instance, Patent Literature 1).

The pair of housings of the headphone disclosed in Patent Literature 1 each include a body containing a speaker unit and a hanger supporting the body. Respective sound-emitting surfaces of the bodies of the housings, which face each other when the headphone is in a normal use state, can be directed rearward by oppositely rotating the housings. In other words, the housings of the headphone are rotatable by 90 degrees with respect to the normal use state.

CITATION LIST

Patent Literature(s)

Patent Literature 1 JP 2016-5058 A

SUMMARY OF THE INVENTION

Problem(s) to be Solved by the Invention

When a typical user uses such a headphone, the headphone is worn in the normal use state. In contrast, specific users such as a DJ (Disc Jockey), who have to monitor music currently played at a site and music to be played next, wear the headphone with one of the right and left housings being put on ear and the other being put along a part other than ear.

In view of the wearing conditions of the users, the housings and the hangers may be configured to be automatically restored to the normal use state with a use of a biasing member (e.g. a spring) after being rotated. According to the above arrangement, a biasing force applied by the biasing member acts to hold a part of a human body (e.g. a head) with the housings after the headphone is worn. In addition, the biasing force reduces the chance of unexpected detachment of the housings from ears, allowing the headphone to be stably worn even when the above specific users use the headphone.

However, resistance against the biasing force is continuously applied by the biasing member when the housings of the headphone arranged as the above are stored in a storing case or the like after being rotated by 90 degrees from the normal use state, so that the biasing force may be weakened. In addition, the housings automatically return to the normal use state even when the above specific users hope that the housings should be kept rotated by 90 degrees in using the headphone, deteriorating the usability for the specific users.

In view of the above problems, an object of the invention is to provide a more user-friendly headphone.

Means for Solving the Problem(s)

A headphone according to an aspect of the invention includes: a headband; a sound emitter including a sound-emitting unit therein; and a connector connecting the sound emitter to the headband. The connector includes: a support that supports the sound emitter so that the sound emitter is rotatable in a predetermined rotation range including a reference position; a restoring portion configured to apply a restoring force on the sound emitter, the restoring force urging the sound emitter to return to the reference position; and a switcher configured to switch a state in which the restoring force acts on the sound emitter and a state in which the restoring force does not act on the sound emitter.

BRIEF DESCRIPTION OF DRAWING(S)

DESCRIPTION OF EMBODIMENT(S)

First Exemplary Embodiment

A first exemplary embodiment of the invention will be described with reference to the attached drawings.

Overall Structure of Headphone

Figure 1:
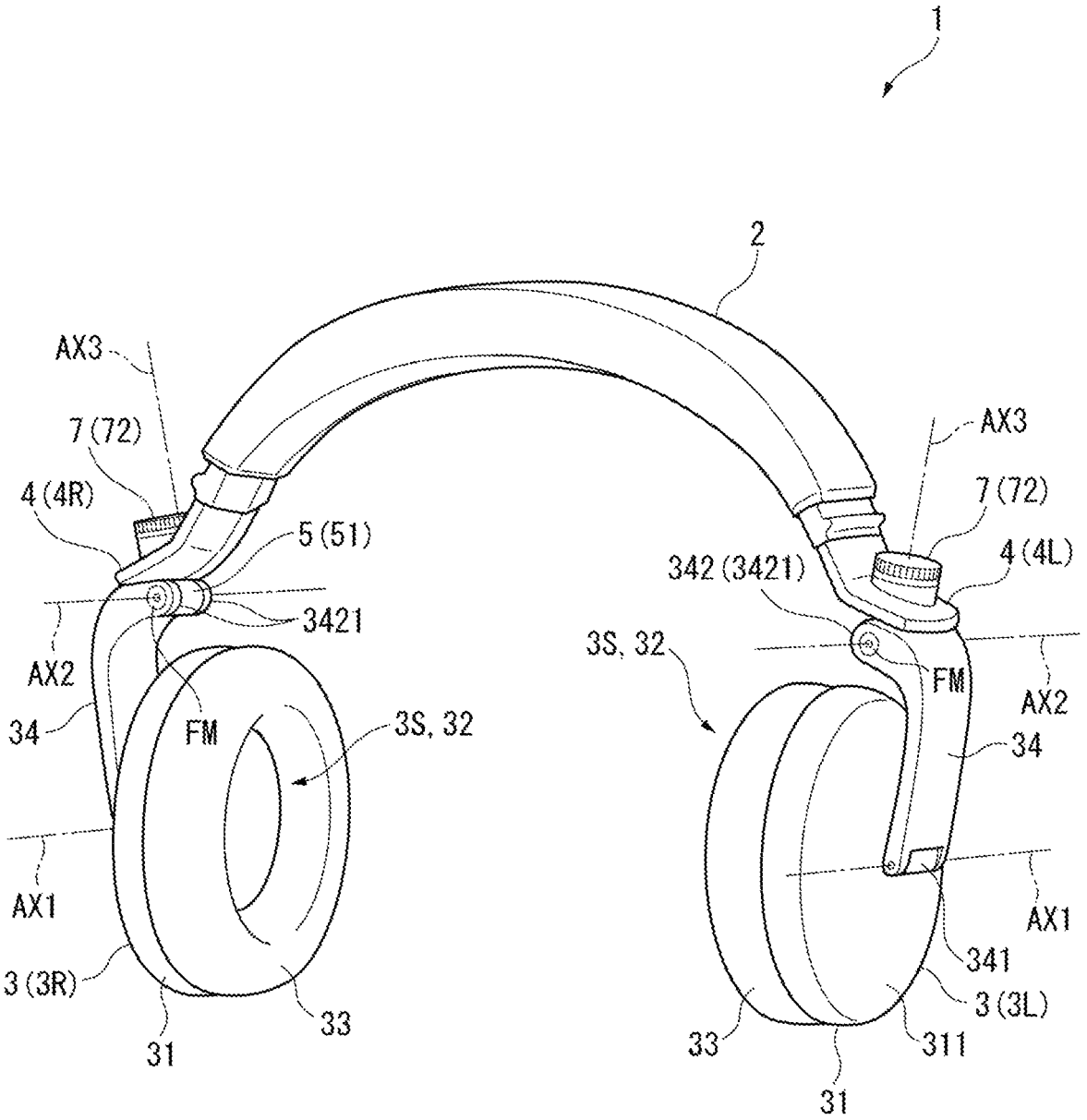
FIG. 1 is a perspective view showing a front side of a headphone according to a first exemplary embodiment of the invention.

FIG. 1 is a perspective view showing a front side of a headphone 1 according to the first exemplary embodiment.

The headphone 1 according to the first exemplary embodiment is configured to be worn on the user's head and output sound to the user's ears. As shown in FIG. 1, the headphone 1 includes a headband 2, a pair of sound emitters 3 (3L, 3R), and a pair of connectors 4 (4L, 4R) provided to right and left ends of the headband 2.

One of the features of the headphone 1 is that the sound emitters 3, which are each supported in a manner rotatable around a rotation axis AX3 along a top-bottom direction, are configured to switch a mode in which the sound emitters 3 are each biased toward a reference position (i.e. a position at which sound-emitting surfaces 3S face each other) and a mode in which the sound emitters 3 are not biased toward the reference position.

It should be noted that "front" and "rear" hereinbelow refer to front and rear with respect to a user who wears the headphone 1. Likewise, "up" and "down" refer to up and down with respect to the user and "right" and "left" refer to right and left with respect to the user.

Components of the headphone 1 will be described below.

Structure of Headband

The headband 2 is an arched member wearable on the head. The headband 2 is arched from the sound emitter 3 (3L) corresponding to the left ear and the sound emitter 3 (3R) corresponding to the right ear. A left end of the headband 2 is provided with the connector 4L connected with the sound emitter 3L and a right end of the headband 2 is provided with the connector 4R connected with the sound emitter 3R. It should be noted that an extension/retraction mechanism capable of extension and retraction along the arched shape of the headband 2 may be provided near each of the right and left ends of the headband 2.

Structure of Sound-Emitter

The pair of sound emitters 3 (right and left sound emitters are denoted by 3R and 3L, respectively) are configured to output a sound corresponding to an inputted audio signal. The sound emitters 3L, 3R each include a housing 31, a sound-emitting unit 32, a pad 33, and a hanger 34.

The housing 31, which is cylindrical, contains the sound-emitting unit 32 (e.g. a speaker) therein. It should be noted that one of the right and left housings 31 is provided with an input cord (not shown) connected to an acoustic device. The acoustic device outputs audio signal for the left ear and audio signal for the right ear, one of which is inputted to the sound-emitting unit 32 in corresponding one of the housings 31 through the input cord. Meanwhile, the other audio signal is inputted to the sound-emitting unit 32 in the other housing 31 through a signal wire (not shown) in the headband 2. It should be noted that the audio signal(s) may be wirelessly received without using the input cord.

The pad 33 is attached to the sound-emitting surface 3S of the housing 31, through which sound is outputted from the sound-emitting unit 32. The pad 33 may be made of a material with cushioning properties (e.g., low-resilience urethane) to be fitted well on the head when the pad 33 is in contact with the head.

The hanger 34 supports the housing 31 while being connected to the corresponding connector 4. The hanger 34 includes a first connecting portion 341 at a lower end and a second connecting portion 342 at an upper end.

The first connecting portion 341 is connected to a surface 311 of the housing 31 opposite the sound-emitting surface 3S. The first connecting portion 341 supports housing 31 so that the housing 31 is rotatable around a rotation axis AX1 that extends along a front-back direction.

The second connecting portion 342 is connected to a connecting member 51 of the connector 4 to connect the hanger 34 with the connector 4. The second connecting portion 342 includes a pair of cylindrical portions 3421 that are spaced in the front-back direction by a predetermined gap. A fixing unit FM is inserted into the cylindrical portions 3421 and a barrel portion 511 (see FIG. 2) of the connecting member 51 with the barrel portion 511 being disposed between the cylindrical portions 3421, so that the hanger 34 is supported by the connecting member 51 in a manner rotatable around a rotation axis AX2 extending along the front-back direction.

It should be noted that, though detailed later, the connecting member 51, which is rotatable around the rotation axis AX3 along the top-bottom direction, allows the hanger 34 and, consequently, sound emitter 3 to rotate around the rotation axis AX3 when the hanger 34 is connected to the connector 4.

Structure of Connector

Figure 2:
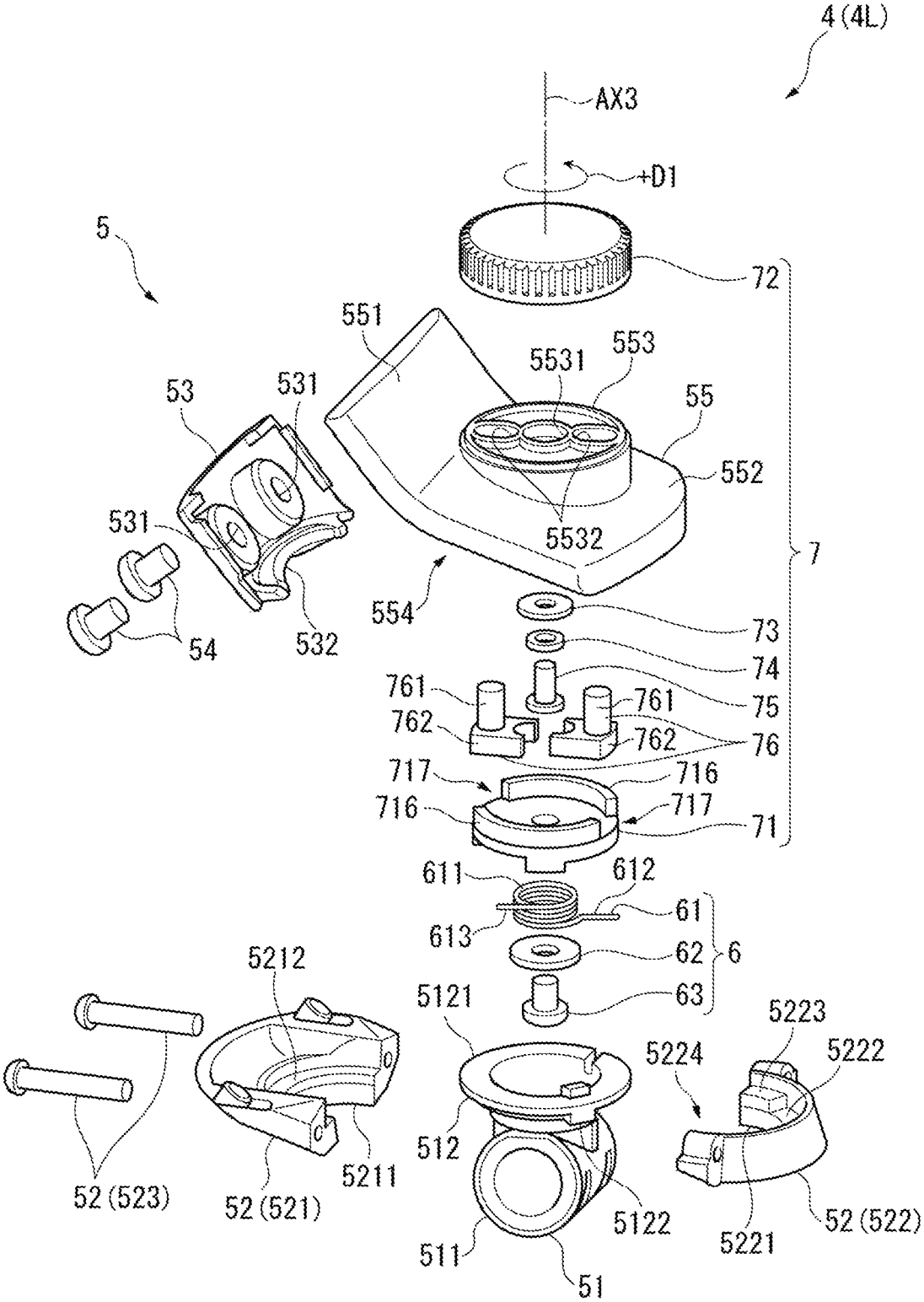
FIG. 2 is an exploded perspective view showing a connector according to the first exemplary embodiment.

FIG. 2 is an exploded perspective view showing the connector 4 (4L). It should be noted that, though FIG. 2 shows the structure of the connector 4L, the connector 4R is similarly structured.

The connectors 4 (right and left connectors are denoted by 4R and 4L, respectively) connect the headband 2 to the hangers 34 (sound emitters 3). As shown in FIG. 2, each of the connectors 4 includes a support 5 that supports the hanger 34 so that the hanger 34 is rotatable, a restoring portion 6 configured to apply on the hanger 34 a restoring force to the reference position, and a switcher 7 configured to switch a state in which the restoring force is applied and a state in which the restoring force is not applied.

It should be noted that the right connector 4 (4R), which is bilaterally symmetrical to the connector 4 (4L), has the same structure as that of the connector 4 (4L). Accordingly, the left connector 4 (4L) will be described below.

Structure of Support

The support 5, which is attached to the headband 2, supports the hanger 34 so that the hanger 34 is rotatable. The support 5 includes the connecting member 51, a first support member 52, a cover 53, a fixing member 54 and a second support member 55. Among the above, the first support member 52, the cover 53, the fixing member 54 and the second support member 55 define the support member of the invention.

Structure of Connecting Member

Figure 3:
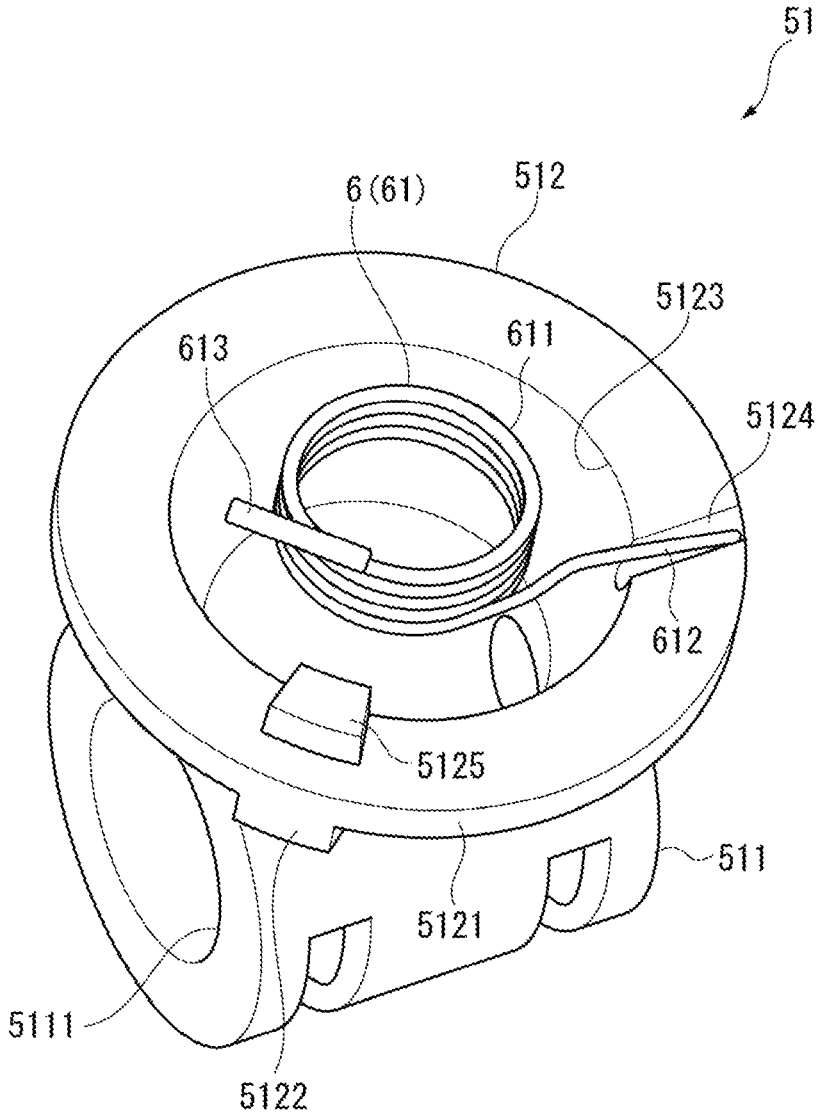
FIG. 3 is a perspective view showing a connecting member according to the first exemplary embodiment as viewed from above.

FIG. 3 is a perspective view showing the connecting member 51 from above. It should be noted that FIG. 3 also shows the restoring portion 6 (a biasing member 61) engaged with the connecting member 51.

The connecting member 51, which is connected to the second connecting portion 342, allows the rotation of the hanger 34 around the rotation axis AX2. As shown in FIG. 3, the connecting member 51 includes the barrel portion 511 at a lower part and a held portion 512 at an upper part.

The barrel portion 511 includes a through hole 5111 penetrating through the barrel portion 511 in the front-back direction. The fixing unit FM (see FIG. 1) is inserted into the through hole 5111.

The held portion 512, whose outer diameter is larger at an upper part than a lower part thereof, is held by the first support member 52 from right and left sides. The held portion 512 includes a flange 5121, a projection 5122, an opening 5123, a recess 5124, and a projection 5125.

The flange 5121 is an annular (as viewed from above) part at an upper end of the held portion 512.

The projection 5122 projects downward from a part of a peripheral edge of the flange 5121. The projection 5122 is configured to be in contact with one of a pair of restricting portions 5223, 5224 (see FIG. 2) of a second holder piece 522 of the first support member 52 when the connecting member 51 is rotated. The restricting portions 5223, 5224 define a rotation range of the connecting member 51 around the rotation axis AX3, as detailed later.

The opening 5123 penetrates through the held portion 512 in the top-bottom direction to be in communication with the through hole 5111.

The recess 5124 is dented downward at a part of a periphery of the opening 5123. An end (extending portion 612) of the later-described biasing member 61 is received by the recess 5124.

The projection 5125 is disposed inside a pair of restricting portions 713, 714 (see FIG. 4) of the later-described piece member 71. The projection 5125 is configured to be in contact with one of the pair of restricting portions 713, 714 when the connecting member 51 is rotated around the rotation axis AX3.

Structure of First Support Member

As shown in FIG. 2, the first support member 52 is a component, in combination with the cover 53, to attach the connecting member 51 to the second support member 55 so that the connecting member 51 is rotatable. The first support member 52 includes a first holder piece 521 and a second holder piece 522. These holder pieces 521, 522 are combined by a pair of fixing members 523, which are inserted along a right-left direction and fixed to the second support member 55. It should be noted that the fixing members 523 are screws in the first exemplary embodiment.

When the headphone 1 is worn by a user, the first holder piece 521 is located at a side of the headphone 1 facing the user and the second holder piece 522 is located at a side opposite the user.

The first holder piece 521 and the second holder piece 522 include semi-circular open portions 5211, 5221, respectively, in which a part of the held portion 512 below the flange 5121 and the projection 5122 is fitted. In addition, the first holder piece 521 includes a recess 5212 formed along the open portion 5211. The second holder piece 522 includes a recess 5222 formed along the open portion 5221. When the first holder piece 521 and the second holder piece 522 are combined, the held portion 512 of the connecting member 51 is held by the first holder piece 521 and the second holder piece 522 from right and left sides. At this time, a part of the flange 5121 near the first holder piece 521 is received within the recess 5212 and a part of the flange 5121 near the second holder piece 522 is received within the recess 5222. The connecting member 51 is thus rotatably supported by the first support member 52.

It should be noted that the second holder piece 522 includes the pair of upward-projecting restricting portions 5223, 5224 in the recess 5222. When the connecting member 51 is combined with the first support member 52, the projection 5122 is located between the pair of restricting portions 5223, 5224. The connecting member 51 is rotatable with respect to the first support member 52 within a range defined by contact points of the projection 5122 to the first and second restricting portion 5223 and 5224. The restricting portions 5223, 5224 thus define the rotation range of the connecting member 51. The position of the sound emitter 3 (e.g. sound emitter 3L) when the projection 5122 is in contact with one of the restricting portions 5223, 5224 defines the reference position at which the sound-emitting surface 3S of the sound emitter 3 squarely faces the other sound emitter (e.g. the sound emitter 3R).

Structure of Cover

Being combined with the first support member 52, the cover 53 is fixed to the second support member 55 (extending portion 551) with the fixing member 54 such as a screw. Thus, the connecting member 51, the first support member 52, the cover 53, and the second support member 55 are integrated.

The cover 53 includes two holes 531, each of which receives corresponding one of the fixing members 54, and a recess 532 to be combined with the first support member 52.

Structure of Second Support Member

The second support member 55 is attached to an end of the headband 2. The first support member 52 and the cover 53 are attached to the second support member 55. As shown in FIG. 2, the second support member 55 includes an extending portion 551 extending along an arch of the headband 2, and a bent portion 552 bent at an end of the extending portion 551 to extend substantially in the right-left direction.

An arrangement base 553, on which a later-described operation member 72 is placed, is provided in a form of a cylinder projecting upward on the bent portion 552. The arrangement base 553 includes a hole 5531 substantially at a center thereof, and a pair of guides 5532 arranged in a line extending in opposite directions across the hole 5531. The pair of guides 5532 each define a hole for receiving a boss 761 of corresponding one of later-described restricting members 76 to restrict a movement of the restricting members 76 in later-described ±D2 directions.

It should be noted that a receiver 554 (see FIG. 8) for receiving a part of the restoring portion 6 and the switcher 7 is provided on a bottom side of the bent portion 552.

Structure of Restoring Portion

The restoring portion 6 is configured to apply a biasing force (restoring force) to the connecting member 51 so that the sound emitter 3 is located at the reference position when the sound emitter 3 is rotated while the later-described switcher 7 is enabled. As shown in FIG. 2, the restoring portion 6 includes the biasing member 61, a washer 62, and a fixing member 63. It should be noted that the restoring portion 6 is "enabled" (in an enabled state) when the biasing force applied by the biasing member 61 is capable of acting on the connecting member 51, and the restoring portion 6 is "disabled" (in a disabled state) when the biasing force is incapable of acting on the connecting member 51.

The biasing member 61 is configured to generate the restoring force and is in a form of a torsion coil spring in the first exemplary embodiment. The biasing member 61 includes a coil 611 having a central axis coaxial with the rotation axis AX3, and extending portions 612, 613 extending from both ends of the coil 611 in mutually different directions.

The coil 611 is disposed to surround a boss 711 projecting from a bottom side of the piece member 71 of the later-described switcher 7. The biasing member 61 is attached to the piece member 71 by attaching the washer 62 and the fixing member 63 onto the boss 711 from below with the boss 711 being surrounded by the coil 611.

The extending portion 612 (i.e. lower one of the extending portion 612, 613) is inserted into the recess 5124 of the connecting member 51. The extending portion 613 (i.e. upper one of the extending portion 612, 613) is locked by a locking portion 712 (see FIG. 4) projecting from the piece member 71.

Structure of Switcher

The switcher 7 is configured to switch the enabled state in which the restoring portion 6 is enabled to allow the restoring force to act on the connecting member 51 (and consequently on the hanger 34) and the disabled state in which the restoring portion 6 is disabled to keep the restoring force from acting on the connecting member 51. As shown in FIG. 2, the switcher 7 includes the piece member 71, the operation member 72, a washer 73, an O-ring 74, a fixing member 75, and the pair of restricting members 76. It should be noted that the switcher of the invention refers to a combination of the switcher 7 and the second support member 55 in the first exemplary embodiment. In other words, the second support member 55 is a component common to the support and the switcher of the invention.

Structure of Piece Member

Figure 4:
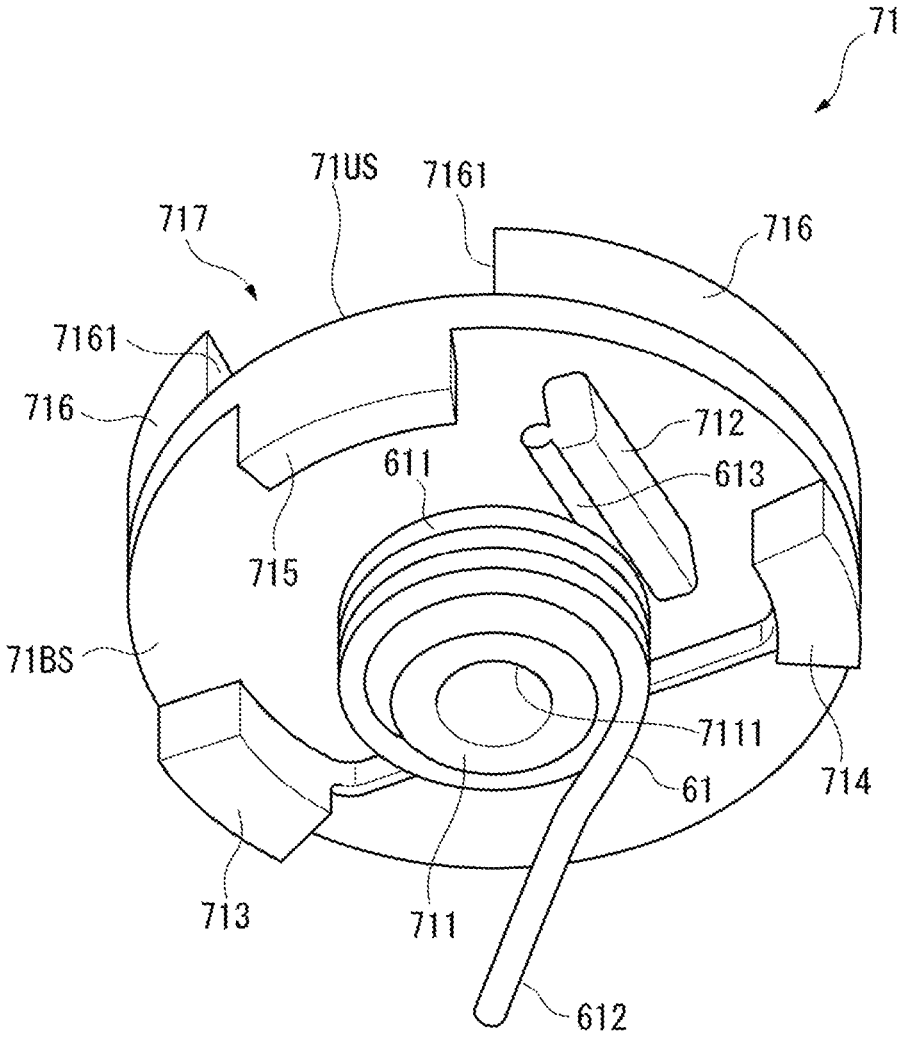
FIG. 4 is a perspective view showing a piece member according to the first exemplary embodiment as viewed from below.

FIG. 4 is a perspective view showing the piece member 71 from below. It should be noted that the biasing member 61 is also shown in FIG. 4.

The piece member 71, which is substantially circular as viewed from above, is disposed in the receiver 554 in a manner rotatable around the rotation axis AX3. The restoring portion 6 is in the disabled state when the rotation of the piece member 71 is allowed and is in the enabled state when the rotation of the piece member 71 is restricted.

As shown in FIG. 4, the piece member 71 includes the boss 711, the locking portion 712, the restricting portions 713, 714 and a projection 715.

The boss 711 projects from the center of a bottom side 71BS of the piece member 71. As described above, the coil 611 of the biasing member 61 is disposed around the boss 711. The boss 711 includes a screw hole 7111, to which the fixing member 63 for attaching the biasing member 61 to the boss 711 is fixed via the washer 62.

The locking portion 712 locks the upper extending portion 613 of the biasing member 61. The locking portion 712 projects from the bottom side 71BS at a position apart from the boss 711.

The restricting portions 713, 714 and the projection 715 project from a periphery of the bottom side 71BS. Among the above, the restricting portions 713, 714 are substantially symmetrical across the boss 711 and are configured to be in contact with the projection 5125. In other words, like the restricting portions 5223 and 5224, the restricting portions 713, 714 are a pair of restricting portions that define the rotation range of the connecting member 51.

Further, as shown in FIGS. 2 and 4, the piece member 71 includes a pair of rising portions 716 and a pair of cutouts 717 defined by peripheral edges of the pair of rising portions 716.

The pair of rising portions 716 rise upward from a periphery of an upper side 71US of the piece member 71. The rising portions 716 are divided by the pair of cutouts 717 symmetrical across a center of the upper side 71US. In other words, the pair of rising portions 716 are symmetrical across the center. The pair of restricting members 76 are disposed in the pair of rising portions 716.

It should be noted that the peripheral edges of the pair of rising portions 716 defining the cutouts 717 and intersecting the upper side 71US are abutment portions 7161 configured to be in contact with the pair of restricting members 76.

Structure of Operation Member

The operation member 72, which is a drive member for moving the restricting members 76, is in a form of a dial in the first exemplary embodiment. As shown in FIG. 2, the operation member 72 is placed to cover the arrangement base 553 of the second support member 55 from above. Specifically, the operation member 72 is rotatably attached to the arrangement base 553 with the fixing member 75 (e.g. a screw) inserted from below into the hole 5531 through the washer 73 and the O-ring 74.

Figure 5:
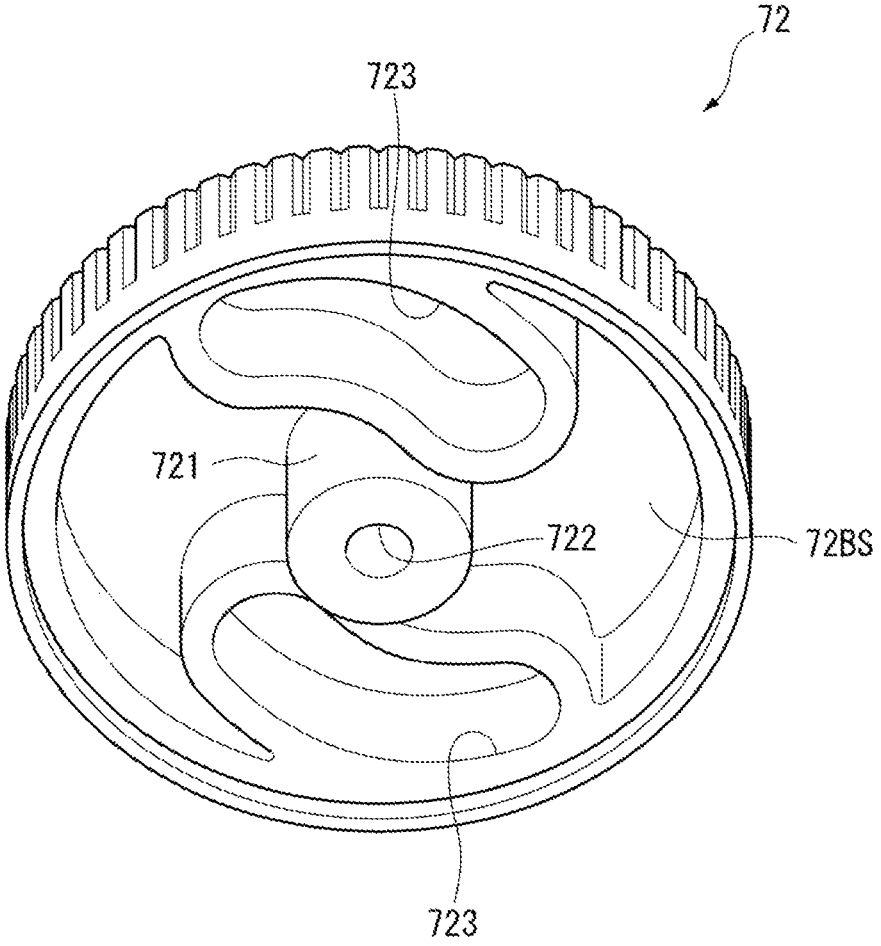
FIG. 5 is a perspective view showing an operation member according to the first exemplary embodiment as viewed from below.

FIG. 5 is a perspective view showing the operation member 72 from below.

As shown in FIG. 5, the operation member 72 includes a boss 721, which has a hole 722 for the fixing member 75 to be fixed therein, at the center of a bottom side 72BS, and a pair of guide grooves 723 that are symmetrical across the boss 721.

The pair of guide grooves 723 each extend in a curve from a part near the center of the bottom side 72BS toward an outside. Specifically, each of the guide grooves 723 define a spiral (volute) around the boss 721. The boss 761 of corresponding one of the restricting members 76 is inserted into each of the guide grooves 723. In accordance with the rotation of the operation member 72, the guide grooves 723 guides the movement of each of the restricting members 76 with the bosses 761 being inserted through the guide 5532 in directions orthogonal to the rotation axis AX3 (specifically in radial directions from the center of the piece member 71). It should be noted that the guide grooves 723 are not necessarily spiral but may linearly extend from an inner side to an outer side of the bottom side 72BS as long as the guide grooves 723 are capable of moving the restricting members 76 in directions as described above.

Structure of Restricting Member

The pair of restricting members 76 are configured to move in accordance with the rotation of the operation member 72 to restrict or allow the rotation of the piece member 71, thereby enabling or disabling the restoring portion 6. As shown in FIG. 2, the pair of restricting members 76 are disposed between the piece member 71 and the second support member 55.

Figure 6:
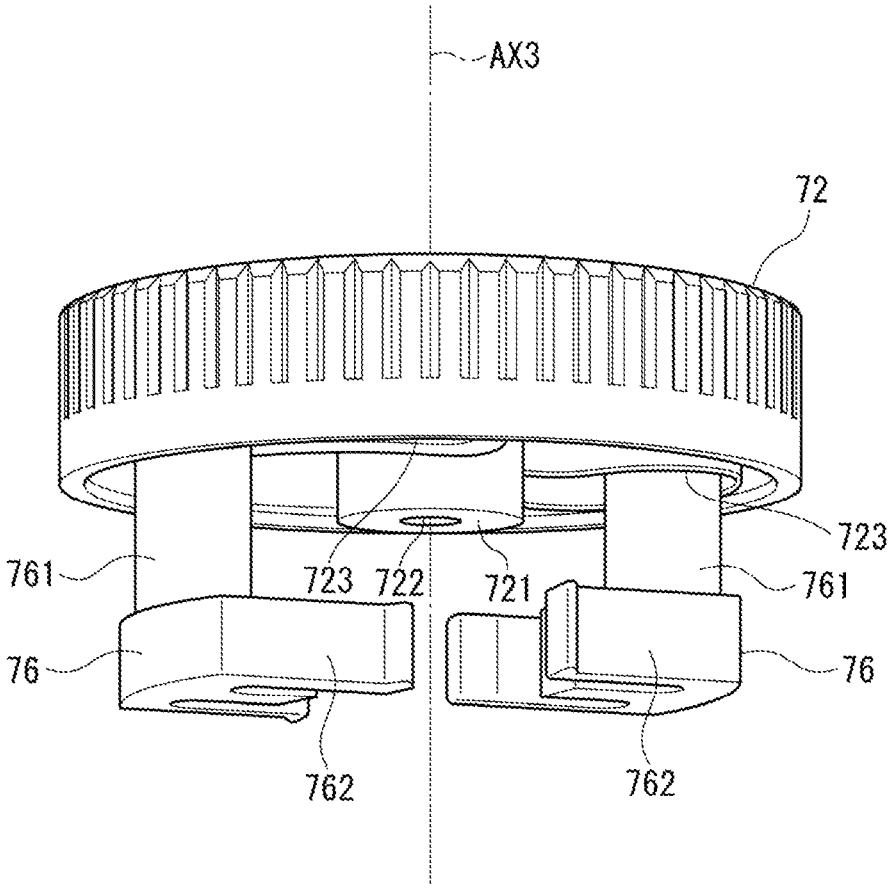
FIG. 6 is a perspective view showing restricting members according to the first exemplary embodiment.

FIG. 6 is a perspective view showing the pair of restricting members 76 whose bosses 761 are inserted into the corresponding one of the guide grooves 723 of the operation member 72.

As shown in FIGS. 2 and 6, each of the restricting members 76 is an integrated component including the boss 761 and a restricting portion 762.

The boss 761 corresponds to the engagement portion of the invention. An upper end of the boss 761 is inserted through the guide 5532 of the second support member 55 to be received in the guide groove 723 of the operation member 72. The bosses 761 move in the radial directions in accordance with the rotation of the operation member 72. The bosses 761 are linearly moved while being guided by the guides 5532.

When the bosses 761 are moved outward in the radial directions, the restricting portions 762 are received in the cutouts 717 to be contactable with the abutment portions 7161. In this state, when the piece member 71 is to be rotated around the rotation axis AX3, the abutment portions 7161 are brought into contact with the respective restricting portions 762 to restrict the rotation of the piece member 71. In this case, since the piece member 71 is unable to rotate together with the connecting member 51, the biasing force of the biasing member 61 is capable of acting on the connecting member 51.

Meanwhile, when the restricting portion 762 is located inside the rising portions 716, since the abutment portions 7161 are not in contact with the restricting portions 762, the rotation of the piece member 71 is not restricted by the restricting members 76. In this case, since the piece member 71 is rotatable coaxially with the biasing member 61 and the connecting member 51, the biasing force (restoring force) of the biasing member 61 is incapable of acting on the connecting member 51.

Enabling Restoring Portion by Switcher

Figure 7:
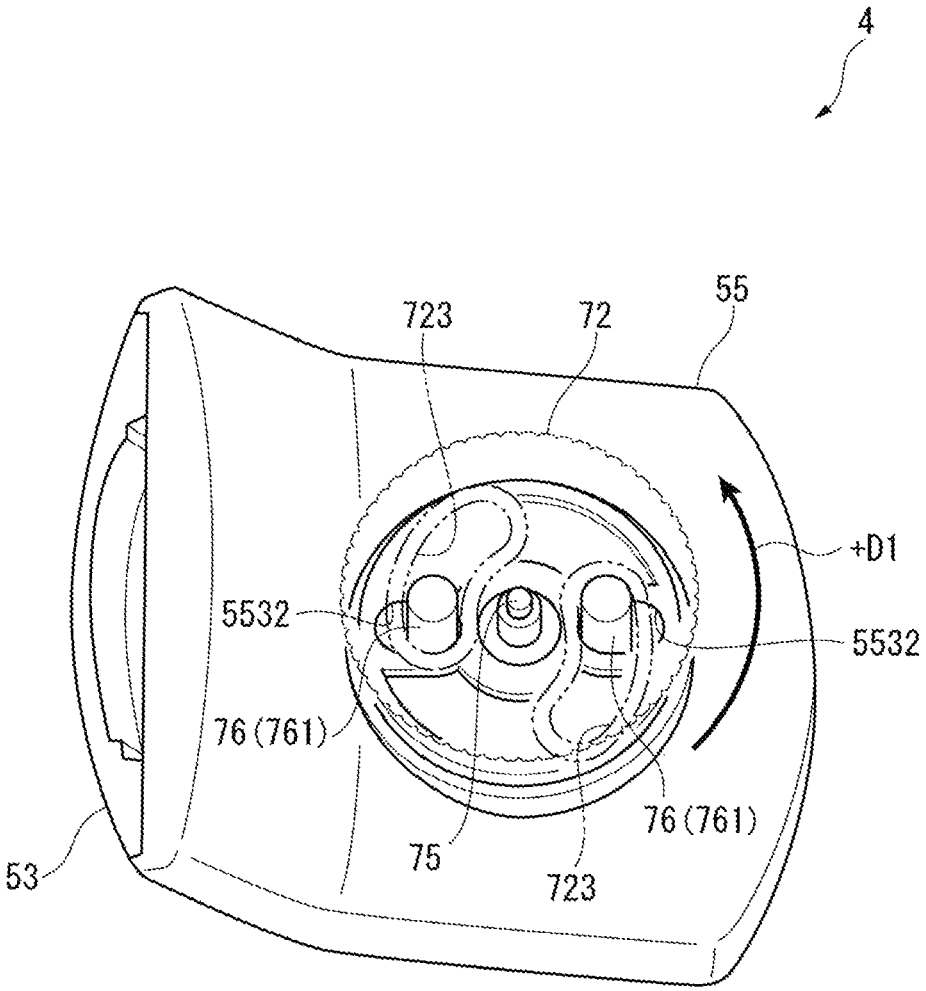
FIG. 7 shows a rotation direction of the operation member when a restoring portion is enabled in the first exemplary embodiment.
Figure 8:
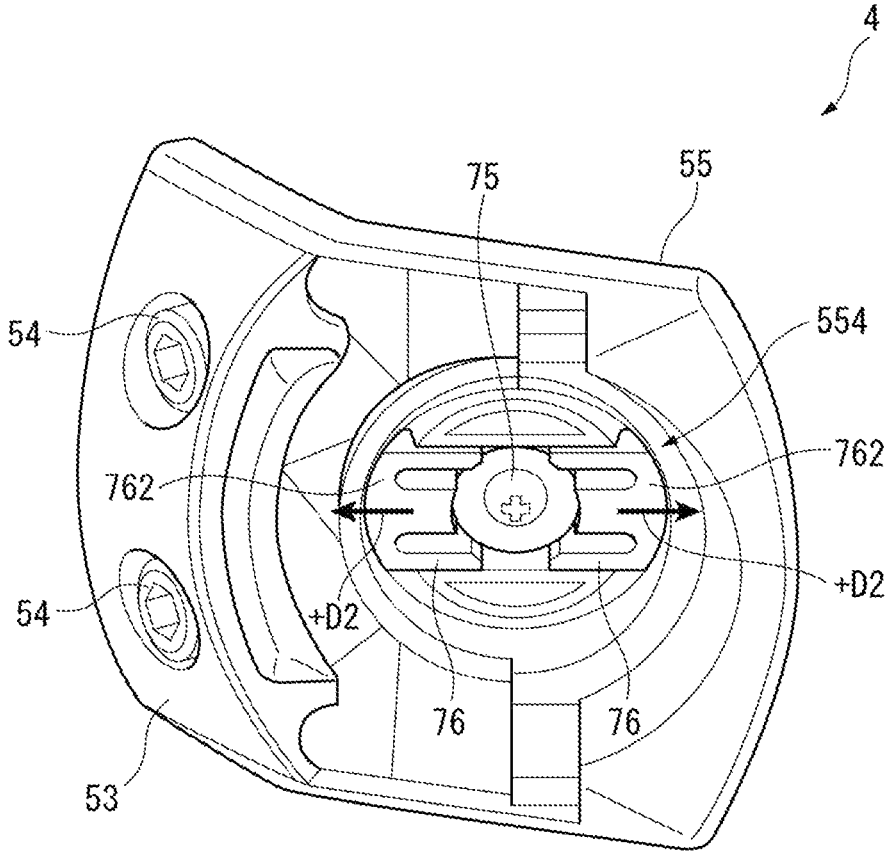
FIG. 8 shows a moving state of the restricting members when the operation member is rotated in the first exemplary embodiment.

FIG. 7 shows a rotation direction (+D1 direction) of the operation member 72 when the restoring portion 6 is enabled. FIG. 8 shows a moving state of the restricting members 76 when the operation member 72 is rotated in the +D1 direction shown in FIG. 7.

When the restoring portion 6 is disabled, the operation member 72 is capable of rotation in the +D1 direction (i.e. a circumferential direction around the rotation axis AX3 shown in FIG. 7). When the operation member 72 is rotated in the +D1 direction, each of the restricting members 76, whose boss 761 is located in the guide groove 723 near the center of the operation member 72, moves toward an outside of the operation member 72 (i.e. outside in the radial direction, +D2 direction shown in FIG. 8) along each of the guides 5532 of the second support member 55, as shown in FIGS. 7 and 8.

Figure 9:
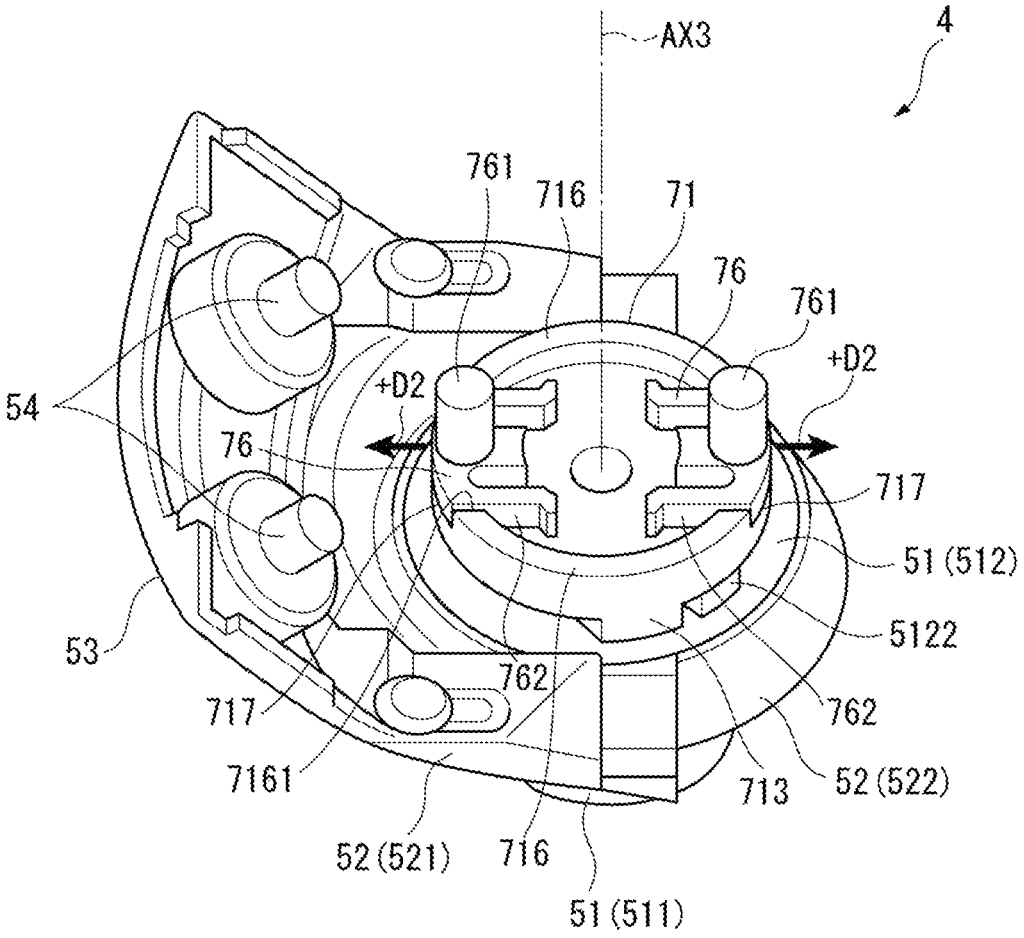
FIG. 9 is a perspective view showing a positional relationship between the restricting members and the piece member according to the first exemplary embodiment.

FIG. 9 is a perspective view showing a positional relationship between each of the restricting members 76 and the piece member 71.

When the operation member 72 is rotated in the +D1 direction to fully move each of the restricting members 76 in the +D2 direction, the restricting portion 762 of each of the restricting members 76 is located in the corresponding one of the cutouts 717 of the piece member 71 and thus is contactable with the abutment portions 7161 as shown in FIG. 9. In this state, even when the piece member 71 is to be rotated together with the connecting member 51 connected with the hanger 34, the rotation of the piece member 71 is restricted by a contact between the restricting portions 762 and respective abutment portions 7161. Accordingly, the biasing force (restoring force) of the biasing member 61, whose extending portion 613 is locked by the piece member 71, is capable of acting on the connecting member 51 engaged with the extending portion 612. The position of the restricting members 76 in this state is a restricting position according to the invention.

It should be noted that the hanger 34 and the connecting member 51 are rotatable around the rotation axis AX3 toward the rear side by 90 degrees with respect to the reference position at which sound-emitting surfaces 3S of the respective sound emitters 3 face each other. As described above, the rotation range of the connecting member 51 is defined by the projection 5122 and the pair of restricting portions 5223, 5224, and the projection 5125 and the pair of restricting portions 713, 714.

The biasing member 61 applies the restoring force on the connecting member 51 when the hanger 34 and the connecting member 51 are rotated in a direction where the sound-emitting surface 3S of the sound emitter 3 face the rear side. Accordingly, the sound emitter 3 can be easily positioned at the reference position, so that the headphone 1 can be easily maintained in an orientation for a typical user to use the headphone 1.

Disabling Restoring Portion by Switcher

Figure 10:
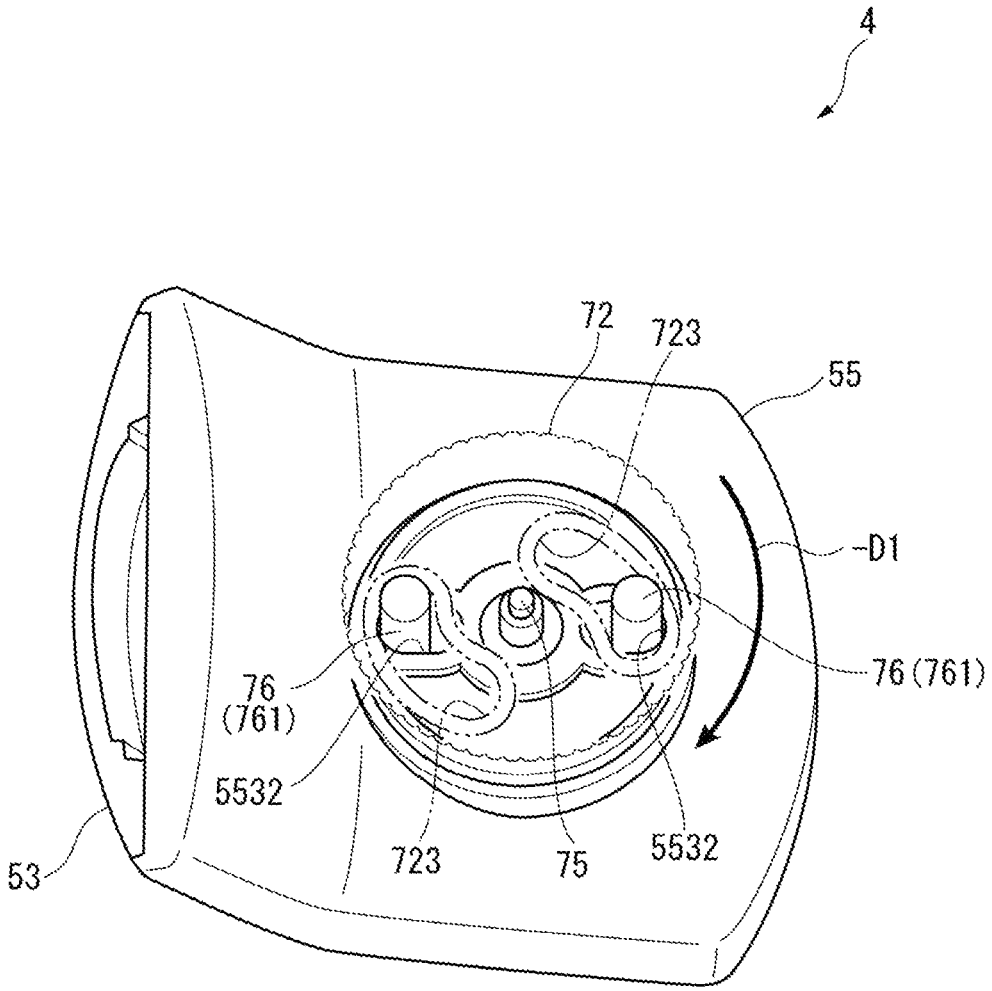
FIG. 10 shows a rotation direction of the operation member when the restoring portion is disabled in the first exemplary embodiment.
Figure 11:
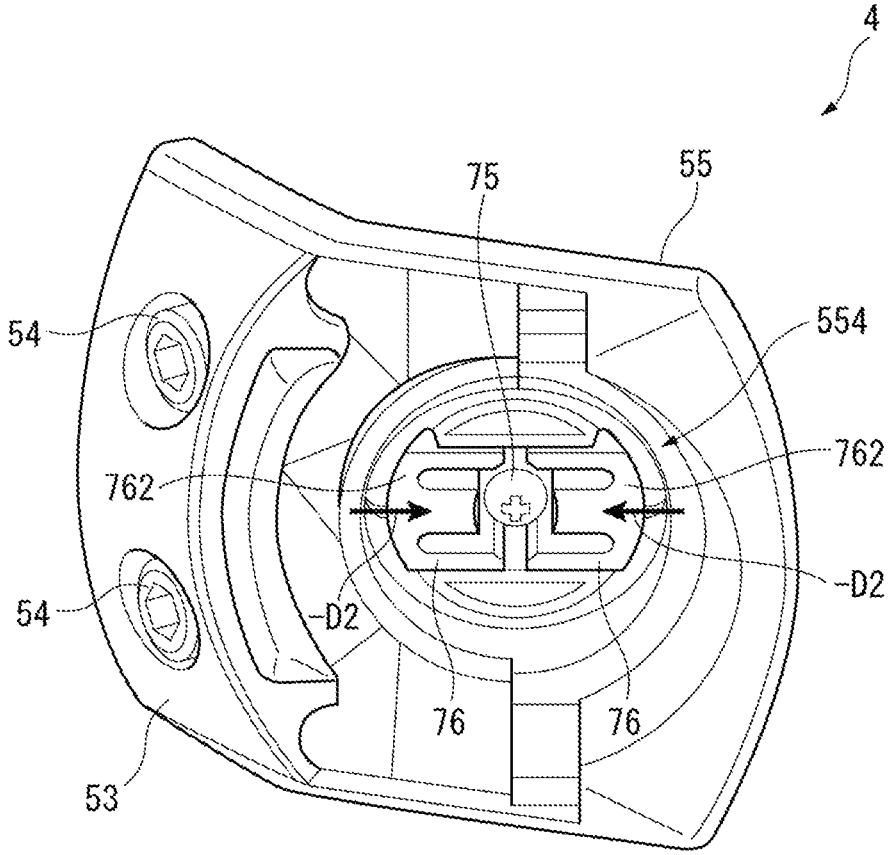
FIG. 11 shows a moving state of the restricting members when the operation member in the first exemplary embodiment is rotated.

FIG. 10 shows a rotation direction (−D1 direction) of the operation member 72 when the restoring portion 6 is disabled. FIG. 11 shows a moving state of the restricting members 76 when the operation member 72 is rotated in the −D1 direction shown in FIG. 10.

When the restoring portion 6 is enabled as described above, the operation member 72 is rotatable in the −D1 direction shown in FIG. 10 (i.e. an opposite direction to the +D1 direction). When the operation member 72 is rotated in the −D1 direction, each of the restricting members 76, whose boss 761 is located in the guide groove 723 near the outer periphery of the operation member 72, moves toward an inside of the operation member 72 (i.e. inside in the radial direction, −D2 direction shown in FIG. 11) along each of the guides 5532 as shown in FIGS. 10 and 11.

Figure 12:
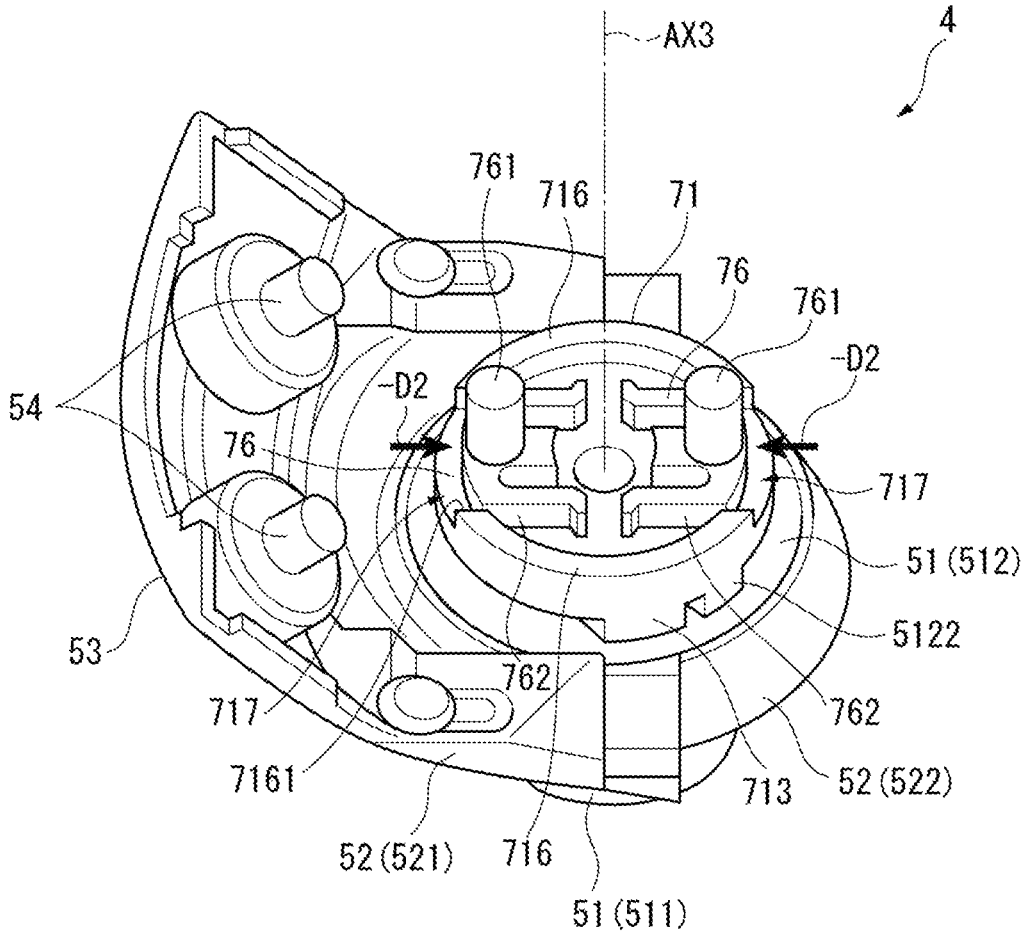
FIG. 12 is a perspective view showing a positional relationship between the restricting members and the piece member according to the first exemplary embodiment.

FIG. 12 is a perspective view showing a positional relationship between each of the restricting members 76 and the piece member 71.

When the operation member 72 is rotated in the −D1 direction to fully move each of the restricting members 76 in the −D2 direction, the restricting portions 762 are located inside the pair of rising portions 716 as shown in FIG. 12. In this state, even when the piece member 71 is rotated together with the connecting member 51 connected with the hanger 34, the abutment portions 7161 are not in contact with the respective restricting portions 762. Accordingly, the biasing member 61 and the piece member 71 are rotated integrally with the connecting member 51, so that the biasing force (restoring force) of the biasing member 61 no more acts on the connecting member 51. Thus, the connecting member 51 and the hanger 34 (sound emitter 3) are capable of freely rotating within the rotation range. The position of each of the restricting members 76 in this state is an allowing position according to the invention.

Advantage(s) of First Exemplary Embodiment

The headphone 1 according to the first exemplary embodiment as described above provides the following advantage(s).

The headphone 1 includes the headband 2; the sound emitter 3 including a sound-emitting unit 32 therein, and the connector 4 connecting the sound emitter 3 to the headband 2. Among the above, the connector 4 includes the support 5 for supporting the sound emitter 3 (hanger 34) so that the sound emitter 3 is rotatable around the rotation axis AX3 along the top-bottom direction in the rotation range including the reference position, the restoring portion 6 for applying the restoring force for restoration to the reference position on the sound emitter 3, and the switcher 7 for switching the enabled state in which the restoring force is capable of acting on the sound emitter 3 and the disabled state in which the restoring force is incapable of acting on the sound emitter 3.

The above arrangement allows switching between the state in which the sound emitter 3 is automatically restored to the reference position, and the state in which sound emitter 3 is freely rotatable. Accordingly, when a typical user uses the headphone 1, the restoring portion 6 is enabled so that the sound emitters 3 can be easily disposed on the right and left ears of the user. Alternatively, when a specific user (e.g. a DJ) uses the headphone 1 with one of the sound emitters 3 being put on one ear and the other one of sound emitters 3 being held along another part of the user, the biasing force applied on the sound emitters 3 allows the headphone 1 to be worn so that the sound emitters 3 hold the body (e.g. head) of the user. Accordingly, the detachment of the sound emitters 3 from ear can be restrained, allowing the user to stably wear the headphone 1. On the other hand, by disabling the restoring portion 6, the sound emitters 3 can be arranged so that the sound-emitting surfaces 3S each face the rear side when the headphone 1 is stored, allowing the headphone 1 to be stored in a compact space. Further, since the enabled state with the restoring portion 6 being enabled and the disabled state with the restoring portion 6 being disabled can be switched, the headphone 1 can be used in a manner suitable for each of various usages of the user. The user-friendliness of the headphone 1 can thus be improved.

The support 5 includes the connecting member 51 connected to the hanger 34 of the sound emitter 3 and engaged with an end (extending portion 612) of the biasing member 61 of the restoring portion 6, and the support member (the first support member 52, the cover 53, and the second support member 55) attached to the headband 2 to support the connecting member 51 so that the connecting member 51 is rotatable. Further, the switcher 7 includes a piece member 71 engaged with the other end (extending portion 613) of the biasing member 61, the restricting members 76 for restricting the rotation of the piece member 71, and the operation member 72 for moving the restricting members 76 to the restricting position and the allowing position. Accordingly, by restricting the rotation of the piece member 71, the enabled state and the disabled state of the restoring portion 6 can be reliably switched. The above arrangement can thus reliably improve the user-friendliness of the headphone 1.

The operation member 72, which is a dial operable by the user, moves the restricting members 76 to one of the restricting position and the allowing position. Accordingly, the user can easily switch the enabled state and the disabled state of the restoring portion 6 by operating the operation member 72.

The restricting members 76 are configured to move along the radial directions (directions orthogonal to the rotation axis AX3) of the piece member 71. The piece member 71 includes the abutment portions 7161 to be in contact with the restricting members 76 when the restricting members 76 are at the restricting position. The rotation of the piece member 71 can thus be reliably restricted and, consequently, the restoring portion 6 can be reliably switched to the enabled state by locating the restricting members 76 at the restricting position.

The piece member 71 includes the rising portions 716 standing on the upper side 71US facing the restricting members 76. The allowing position is located inside (i.e. near the center) of the piece member 71 with respect to the rising portions 716. The restricting position is located near the outside of the piece member 71 with respect to the rising portions 716. The restricting members 76 can thus be located at the position not in contact with the piece members 71 by locating the restricting members 76 at the allowing position, so that the rotation of the piece member 71 can be reliably restricted. The piece member 71 to be rotated can thus be brought into contact with the restricting members 76 when the restricting members 76 are located at the restricting position, so that the rotation of the piece member 71 can be reliably restricted. Accordingly, the enabled state and the disabled state of the restoring portion 6 can be reliably switched by moving the restricting members 76 to the allowing position and the restricting position.

The abutment portions 7161 of the piece member 71 to be brought into contact with the restricting members 76 are defined by the peripheral edges of the cutouts 717 defined in the rising portion 716. The abutment portions 7161 can thus be reliably brought into contact with the restricting members 76 (restricting portions 762) when the piece member 71 is rotated with the restricting members 76 being located inside the cutouts 717 (restricting position). Accordingly, the rotation of the piece member 71 can be reliably restricted, so that the biasing force (restoring force) of the restoring portion 6 can be reliably applied on the connecting member 51 and, consequently, on the hanger 34 of the sound emitter 3.

The second support member 55 includes the guides 5532 through which the bosses 761 (the engagement portions) of the restricting members 76 are inserted to guide the movement of the restricting members 76. The linear movement of the restricting members 76 can thus be facilitated, so that the restricting members 76 can be reliably moved to the restricting position or the allowing position. Particularly, since the operation member 72 is in a form of a dial in the first exemplary embodiment, the rotation of the operation member 72 can be reliably converted to the linear movement of the restricting members 76 by the linearly extending guides 5532. Accordingly, the enabled state and the disabled state of the restoring portion 6 can be reliably switched by the user's operation on the operation member 72.

The operation member 72 is a dial capable of rotation around the rotation axis AX3. Further, the operation member 72 includes the guide grooves 723 each configured to receive corresponding one of the respective bosses 761 and move the restricting members 76 in the radial directions of the piece member 71 in response to the rotation of the operation member 72. The restricting members 76 can thus be reliably moved in the radial directions of the piece member 71 in response to the rotation of the operation member 72, so that the restricting members 76 can be reliably located at the allowing position and the restricting position. Accordingly, the enabled state and the disabled state of the restoring portion 6 can be reliably switched by the user's operation on the operation member 72.

Two restricting members 76 are disposed across the center of the piece member 71 (i.e. the rotation axis AX3). The stability in restricting the rotation of the piece member 71 by the restricting members 76 can thus be enhanced as compared with an instance provided with a single restricting member 76. Accordingly, the rotation of the piece member 71 can be reliably and stably restricted.

The restoring portion 6 includes the biasing member 61 in a form of a torsion coil spring. The restoring portion 6 configured to connect the connecting member 51 and the piece member 71 can thus be relatively easily provided. Accordingly, the structure of the connector 4 can be simplified.

Second Exemplary Embodiment

Next, a second exemplary embodiment of the invention will be described.

A headphone according to the second exemplary embodiment is structurally the same as the headphone 1 except that the sound emitters 3 are capable of being locked at an angle (rotation angle) desired by a user. It should be noted that the same or substantially the same parts as already described will be denoted by the same reference characters hereinbelow for omission of the description thereof.

Figure 13:
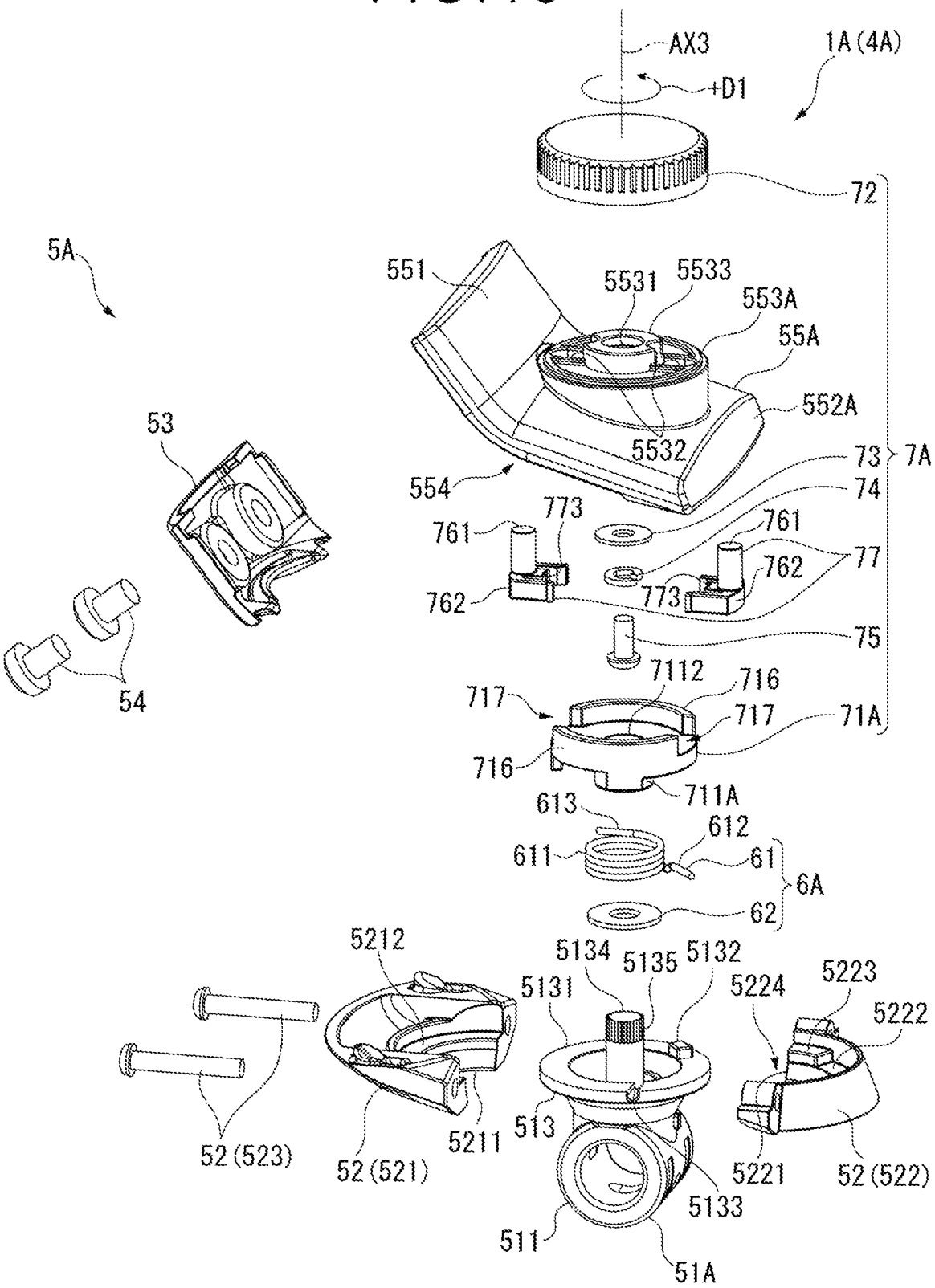
FIG. 13 is an exploded perspective view showing a structure of a connector of a headphone according to a second exemplary embodiment of the invention.

FIG. 13 is an exploded perspective view showing a structure of a connector 4A of a headphone 1A according to the second exemplary embodiment.

The headphone 1A according to the second exemplary embodiment is structurally and functionally the same as the headphone 1 except for a pair of connectors 4A, which are provided in place of the pair of connectors 4.

Each of the pair of connectors 4A is provided to corresponding one of the right and left ends of the headband 2 in the same manner as the pair of connectors 4 and is configured to support corresponding one of the sound emitters 3 (hangers 34) so that the sound emitters 3 (hangers 34) are rotatable around the rotation axis AX3 along the top-bottom direction, thereby connecting the headband 2 and the sound emitters 3. As shown in FIG. 13, each of the connectors 4A includes a support 5A, a restoring portion 6A, and a switcher 7A.

Among the above, the restoring portion 6A includes the biasing member 61 and the washer 62 as the restoring portion 6 but does not include the fixing member 63.

It should be noted that the connector 4A located on the left side and the connector 4A located on the right side with respect to the headband 2 are symmetrically arranged but of the same structure in other respects. Accordingly, the connector 4A located on the left side will be described and the description on the connector 4A located on the right side will be omitted hereinbelow.

Structure of Support

As in the support 5, the support 5A is attached to the headband 2 with the hanger 34 being connected, thereby supporting the hanger 34 (and, consequently, the sound emitter 3) so that the hanger 34 (and, consequently, the sound emitter 3) is rotatable. The support 5A includes a connecting member 51A, the first support member 52, the cover 53, the fixing member 54 and a second support member 55A.

Structure of Connecting Member

As in the connecting member 51, the connecting member 51A is connected to the second connecting portion 342 (see FIG. 1) so that the hanger 34 is rotatable around the rotation axis AX2 (see FIG. 1) along the front-back direction. The connecting member 51A includes the barrel portion 511 at a lower part and a held portion 513 at an upper part.

The held portion 513 includes an annular flange 5131 extending radially outward from the circumference of the held portion 513, a projection 5132 and a recess 5133 provided on the flange 5131, and a shaft portion 5134.

The projection 5132 projects from an upper side of the flange 5131. As in the projection 5125, the projection 5132 is disposed inside the pair of restricting portions 713, 714 (see FIG. 4) of a piece member 71A. The projection 5132 is configured to be in contact with one of the pair of restricting portions 713, 714 when the connecting member 51 is rotated around the rotation axis AX3.

As in the recess 5124, the recess 5133 receives the extending portion 612 of the biasing member 61 to lock the extending portion 612.

The shaft portion 5134 is a cylindrical member standing upward from a bottom of the held portion 513. An upper end of the shaft portion 5134 projects upward beyond the flange 5131. When the connecting member 51A and the piece member 71A are connected through the biasing member 61 of the restoring portion 6A, the shaft portion 5134 is inserted through an insertion hole 7112 of the piece member 71A from below to be exposed at an upper side of the piece member 71A. A meshing portion 5135 with multiple teeth, which is capable of meshing with restricting members 77 placed on an upper side of the piece member 71A, is provided on a circumference of an end of the shaft portion 5134.

Structure of Second Support Member

As in the second support member 55, the second support member 55A is attached to the headband 2 using the fixing member 54 together with the cover 53. The first support member 52 holding the connecting member 51A is also attached to the second support member 55A. The second support member 55A includes the extending portion 551 and a bent portion 552A bent at an end of the extending portion 551 to extend substantially in the right-left direction.

The bent portion 552A includes an arrangement base 553A, on which the operation member 72 is placed. As in the arrangement base 553, the arrangement base 553A is in a form of a cylinder projecting upward. The arrangement base 553A includes the hole 5531 at the center thereof, the pair of guides 5532 disposed across the hole 5531, and the receiver 554.

The arrangement base 553A further includes a projection 5533 projecting upward from a surface of the arrangement base 553A facing the operation member 72. The hole 5531 is formed in the projection 5533. The pair of guides 5532 partially cut into the projection 5533.

Structure of Switcher

As in the switcher 7, the switcher 7A is configured to switch applying and not applying the restoring force by the restoring portion 6A on the connecting member 51A. As shown in FIG. 13, the switcher 7A is constructed in the same manner as the switcher 7 except that the piece member 71A and a pair of restricting members 77 are provided in place of the piece member 71 and the pair of restricting members 76. It should be noted that the switcher of the invention refers to a combination of the switcher 7A and the second support member 55A in the second exemplary embodiment.

Structure of Piece Member

As in the piece member 71, the piece member 71A, which is substantially circular as viewed from above, is received in the receiver 554 of the second support member 55A in a manner rotatable around the rotation axis AX3. The restoring portion 6A is in the disabled state when the rotation of the piece member 71A is allowed and is in the enabled state when the rotation of the piece member 71A is restricted by the restricting members 77.

The piece member 71A has the same structure as that of the piece member 71 except for a boss 711A in place of the boss 711.

In place of the screw hole 7111, the boss 711A includes an insertion hole 7112 penetrating therethrough along the rotation axis AX3. The shaft portion 5134 is inserted through the insertion hole 7112.

Structure of Restricting Member

The pair of restricting members 77 are configured to move in accordance with the movement of the operation member 72 to restrict or allow the rotation of the piece member 71A, thereby enabling or disabling the restoring portion 6A. As shown in FIG. 13, the pair of restricting members 77 are disposed between the piece member 71A and the second support member 55A. As in the restricting members 76, each of the pair of restricting members 77 includes the boss 761 and the restricting portion 762.

Figure 14:
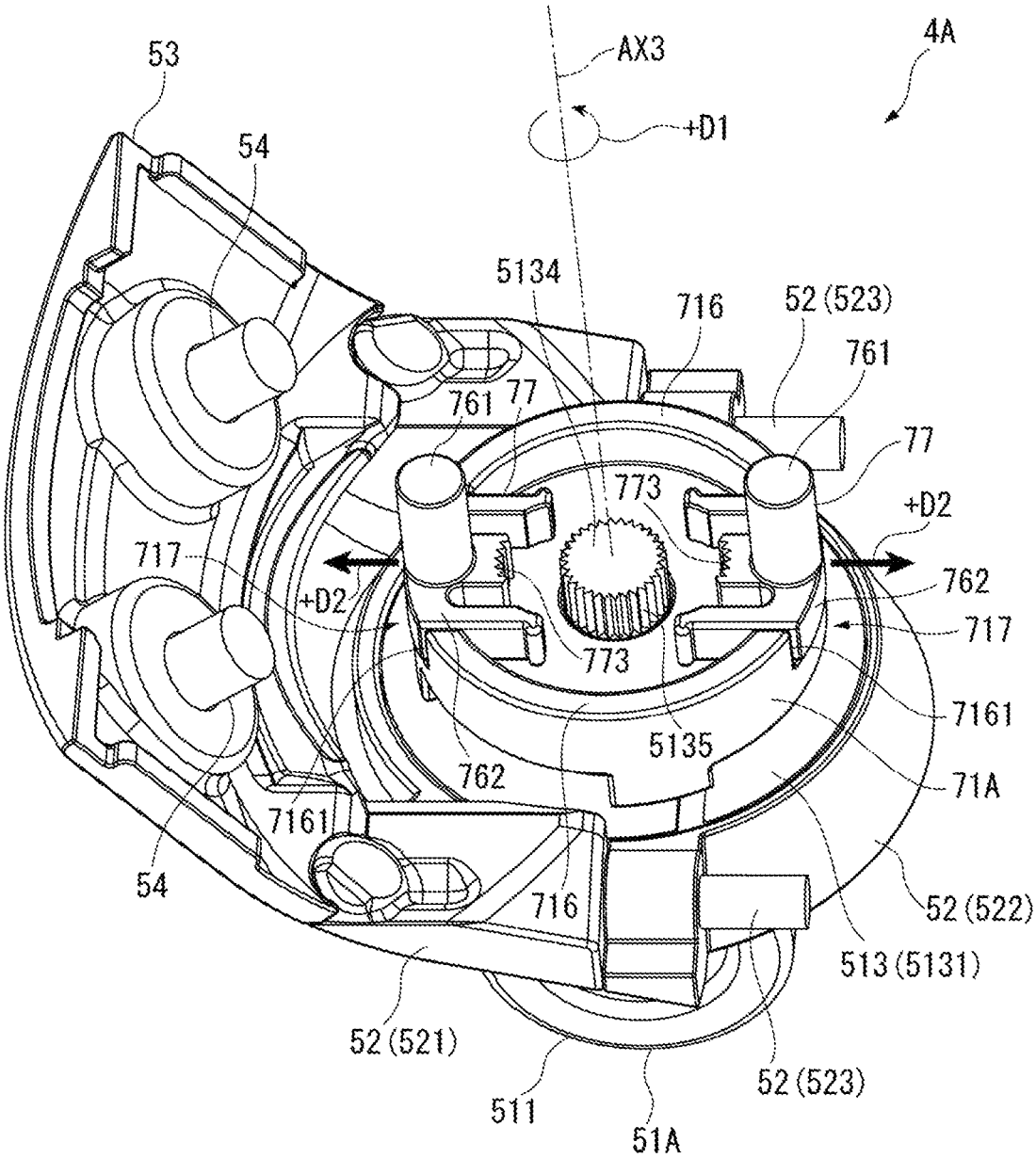
FIG. 14 is a perspective view showing a positional relationship of a shaft portion, a piece member, and restricting members in the second exemplary embodiment.

FIG. 14 is a perspective view showing a positional relationship between the shaft portion 5134 of the connecting member 51A, the piece member 71A, and the restricting members 77. Specifically, FIG. 14 is a perspective view showing an interior of the connector 4A when the rotation of the piece member 71A is restricted by the restricting members 77 to enable the restoring portion 6A.

Further, each of the pair of restricting members 77 includes a locking portion 773 at a part facing the meshing portion 5135 of the connecting member 51A as shown in FIG. 14. The locking portion 773 includes multiple teeth configured to mesh with the meshing portion 5135. When the pair of restricting members 77 are moved toward an inside of the piece member 71A (i.e. in a direction toward the meshing portion 5135) in response to the rotation of the operation member 72, the locking portion 773 meshes with the meshing portion 5135. The connecting member 51A (and, consequently, the sound emitter 3) is thus locked to be fixed.

Enabling Restoring Portion by Switcher

As in the connector 4, when the pair of restricting members 77 are fully moved in the +D2 direction (i.e. radially outward from the rotation axis AX3) in response to the rotation of the operation member 72 in the +D1 direction around the rotation axis AX3, the restricting portions 762 of the respective restricting members 77 are received in the corresponding cutouts 717 of the piece member 71A as shown in FIG. 14. In this state, each of the restricting portions 762 are in contact with corresponding one of abutment portions 7161 to restrict the rotation of the piece member 71A. Accordingly, the biasing force (restoring force) of the biasing member 61, whose extending portion 613 is engaged with the piece member 71A, is capable of acting on the connecting member 51A engaged with the extending portion 612. The position of each of the restricting members 77 in this state is the restricting position according to the invention.

It should be noted that the hanger 34 and the connecting member 51A are, in the same manner as the above, rotatable around the rotation axis AX3 toward the rear side by 90 degrees with respect to the reference position at which sound-emitting surfaces 3S of the sound emitters 3 face each other. The biasing member 61 applies the restoring force on the connecting member 51A when the sound-emitting surface 3S of the sound emitter 3 is rotated in a direction to face the rear side. Accordingly, the sound emitter 3 can be easily positioned at the reference position, so that the headphone 1A can be easily maintained in an orientation for a typical user to use the headphone 1A.

Disabling Restoring Portion by Switcher

Figure 15:
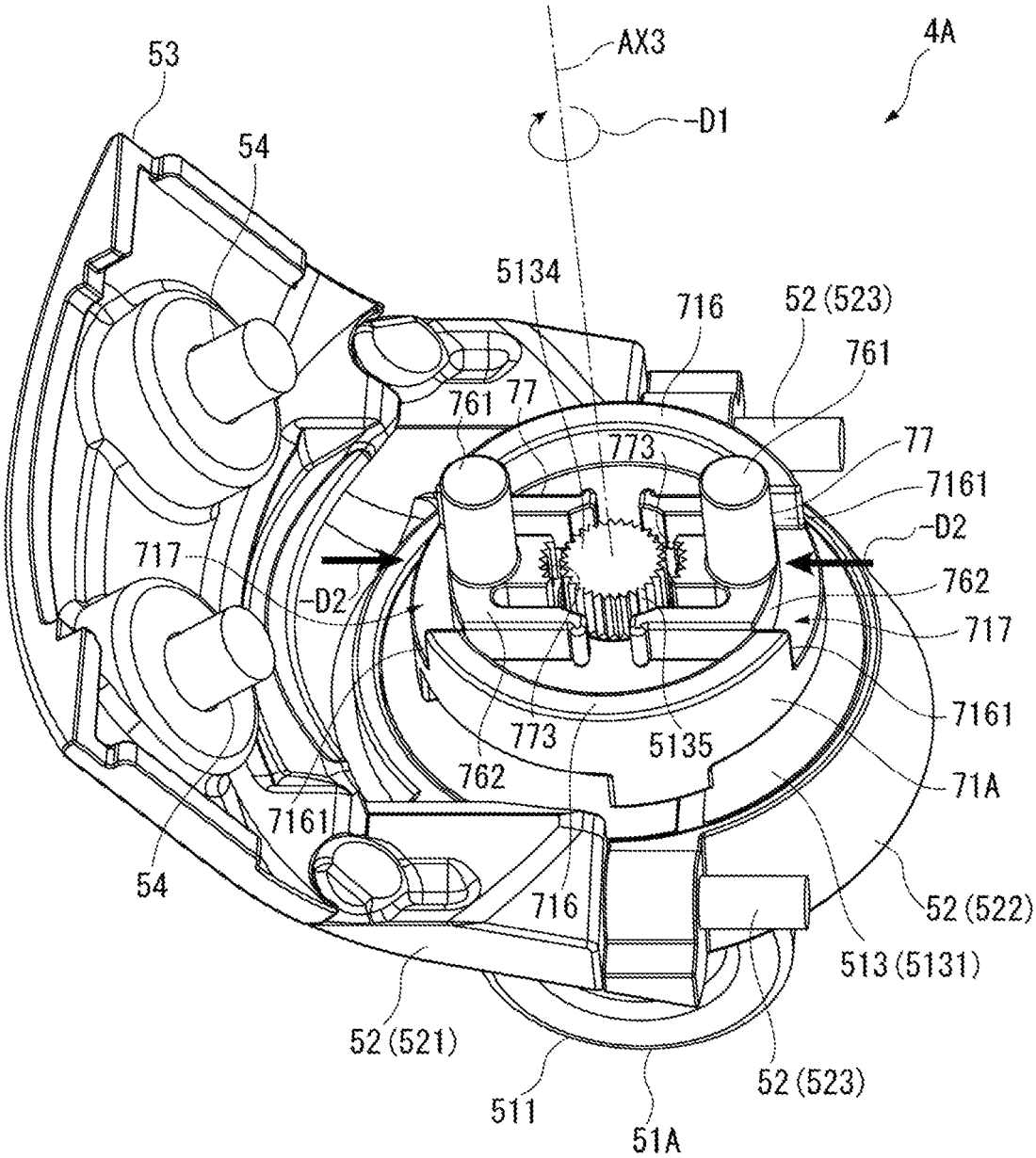
FIG. 15 is a perspective view showing an interior of the connector when a restoring portion is disabled in the second exemplary embodiment.

FIG. 15 is a perspective view showing the interior of the connector 4A when the rotation of the piece member 71A is allowed by the restricting members 77 to disable the restoring portion 6A.

When the operation member 72 is rotated in the −D1 direction (i.e. an opposite direction to the +D1 direction), the bosses 761 at an outer part of the operation member 72 move toward the inner part of the operation member 72 along the guides 5532. The restricting members 77 are thus moved in the −D2 direction (i.e. an opposite direction to the +D2 direction) as shown in FIG. 15, so that the restricting portions 762 are located inside the pair of rising portions 716 of the piece member 71A. In this state, even when the piece member 71A is rotated together with the connecting member 51A, the abutment portions 7161 are not in contact with the respective restricting portions 762. Accordingly, the biasing member 61 and the piece member 71A are rotated integrally with the connecting member 51A, so that the biasing force (restoring force) of the biasing member 61 no more acts on the connecting member 51A. Thus, the connecting member 51A and the sound emitter 3 are capable of freely rotating within the rotation range. The position of each of the restricting members 77 in this state is the allowing position according to the invention.

Locking Connecting Member by Switcher

Figure 16:
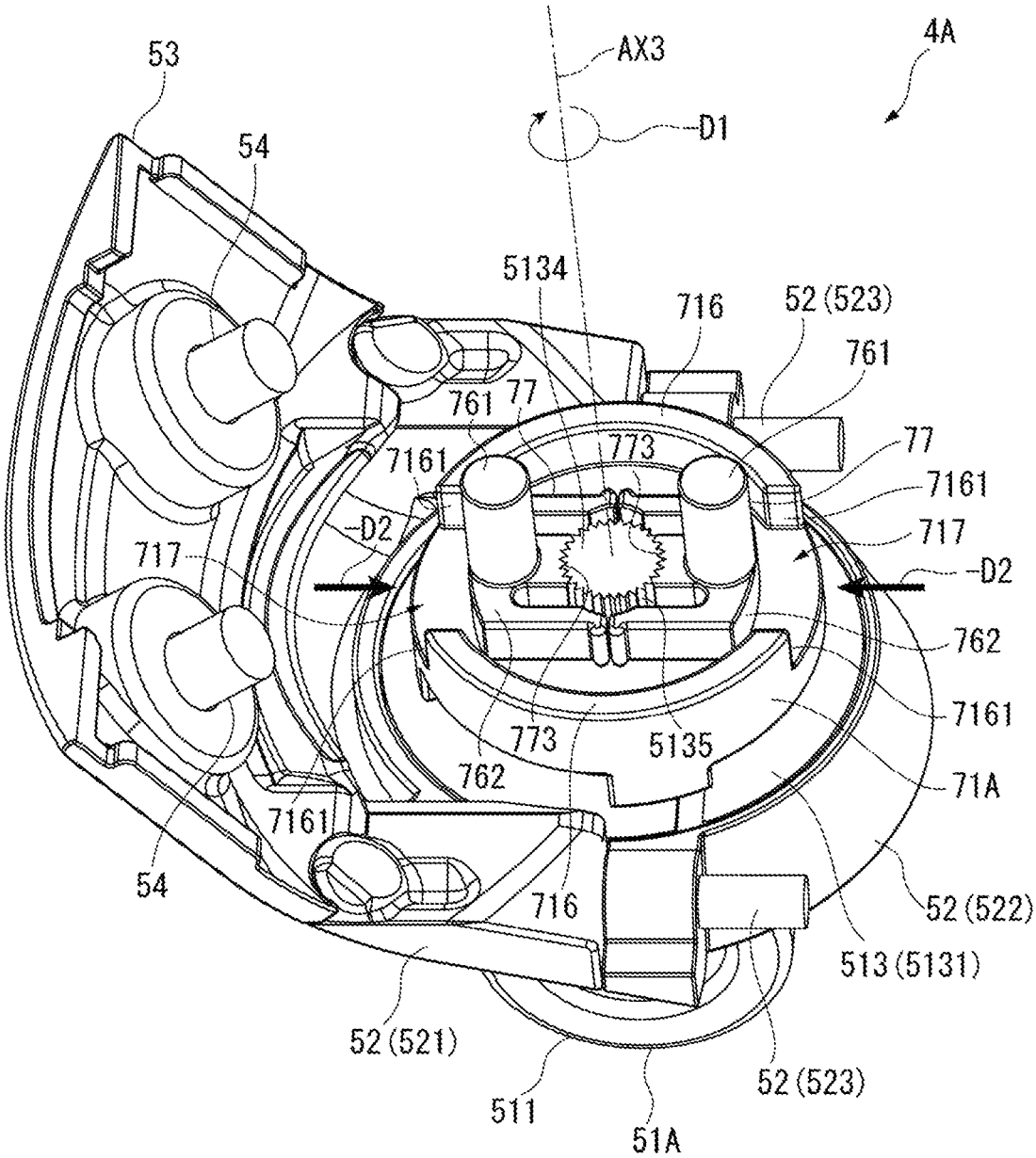
FIG. 16 is a perspective view showing an interior of the connector when a locking portion is meshed with a meshing portion in the second exemplary embodiment.

FIG. 16 is a perspective view showing the interior of the connector 4A when the locking portion 773 is meshed with the meshing portion 5135 of the connecting member 51A. Specifically, FIG. 16 is a perspective view showing the interior of the connector 4A when the connecting member 51A is locked by the locking portion 773.

When the operation member 72 is further rotated in the −D1 direction to fully move each of the restricting members 77 in the −D2 direction, the locking portion 773 of each of the restricting members 77 is meshed with the meshing portion 5135 of the connecting member 51A to lock the connecting member 51A as shown in FIG. 16. In this state, since the rotation of the connecting member 51A is, even tried, restricted by the restricting members 77, the position of the connecting member 51A and, consequently, the hanger 34 (sound emitter 3) is fixed. The position of each of the restricting members 77 in this state is referred to as a fixing position.

It should be noted that the meshing portion 5135 is continuously formed on a circumferential surface of the shaft portion 5134 held by the pair of restricting members 77 (i.e. over an entire circumference of the shaft portion 5134), and the connecting member 51A is freely rotatable within the rotation range until being locked by the locking portion 773. Accordingly, the connecting member 51A and, consequently, the sound emitter 3 can be fixed at a desired angle by meshing the locking portions 773 of the restricting members 77 with the meshing portion 5135 while the connecting member 51A is rotated by the desired angle (predetermined rotation angle).

Advantage(s) of Second Exemplary Embodiment

The headphone 1A according to the second exemplary embodiment as described above can achieve not only the same advantages as those of the headphone 1 but also the following advantages.

When the operation member 72 is fully rotated in the −D1 direction, the pair of restricting members 77 hold and lock the connecting member 51A. Specifically, the locking portion 773 of each of the restricting members 77 is meshed with the meshing portion 5135 to lock and fix the connecting member 51A and, consequently, the sound emitter 3. The sound emitter 3 can thus be kept rotated at an angle desired by the user. The user-friendliness of the headphone 1A can thus be improved.

Further, since the locking portion 773 of each of the restricting members 77 meshes with the meshing portion 5135 of the connecting member 51A, the rotation of the connecting member 51A can be reliably restricted as compared with the restricting member 77 simply holding the shaft portion 5134. In addition, since it is not necessary for the restricting members 77 to continuously apply the pushing force on the shaft portion 5134, the load applied on the restricting members 77 can be reduced.

Though not shown in the drawings, the operation member 72 may be configured so that the position thereof is fixed or temporarily fixed when the restricting members 77 are located at at least one of the restricting position, the allowing position, and the fixing position.

For instance, a projection may be provided on one of the operation member 72 and the arrangement base 553A and at least one recess for receiving the projection may be provided on the other of the operation member 72 and the arrangement base 553A at a position corresponding to the position of the projection when the restricting members 77 are located at at least one of the restricting position, the allowing position, and the fixing position.

With the connector 4A configured as described above, the user can easily recognize how and/or whether the connecting member 51A and the sound emitter 3 are restricted by the operation member 72, and unexpected rotation of the operation member 72, which could change the restricted condition of the connecting member 51A and the sound emitter 3, can be restrained.

Third Exemplary Embodiment

Next, a third exemplary embodiment of the invention will be described.

A headphone according to the third exemplary embodiment is structurally the same as the headphone 1 except that the headphone of the third exemplary embodiment is further configured to reduce the load applied on the restricting members 76. It should be noted that the same or substantially the same parts as already described will be denoted by the same reference characters hereinbelow for omission of the description thereof.

Figure 17:
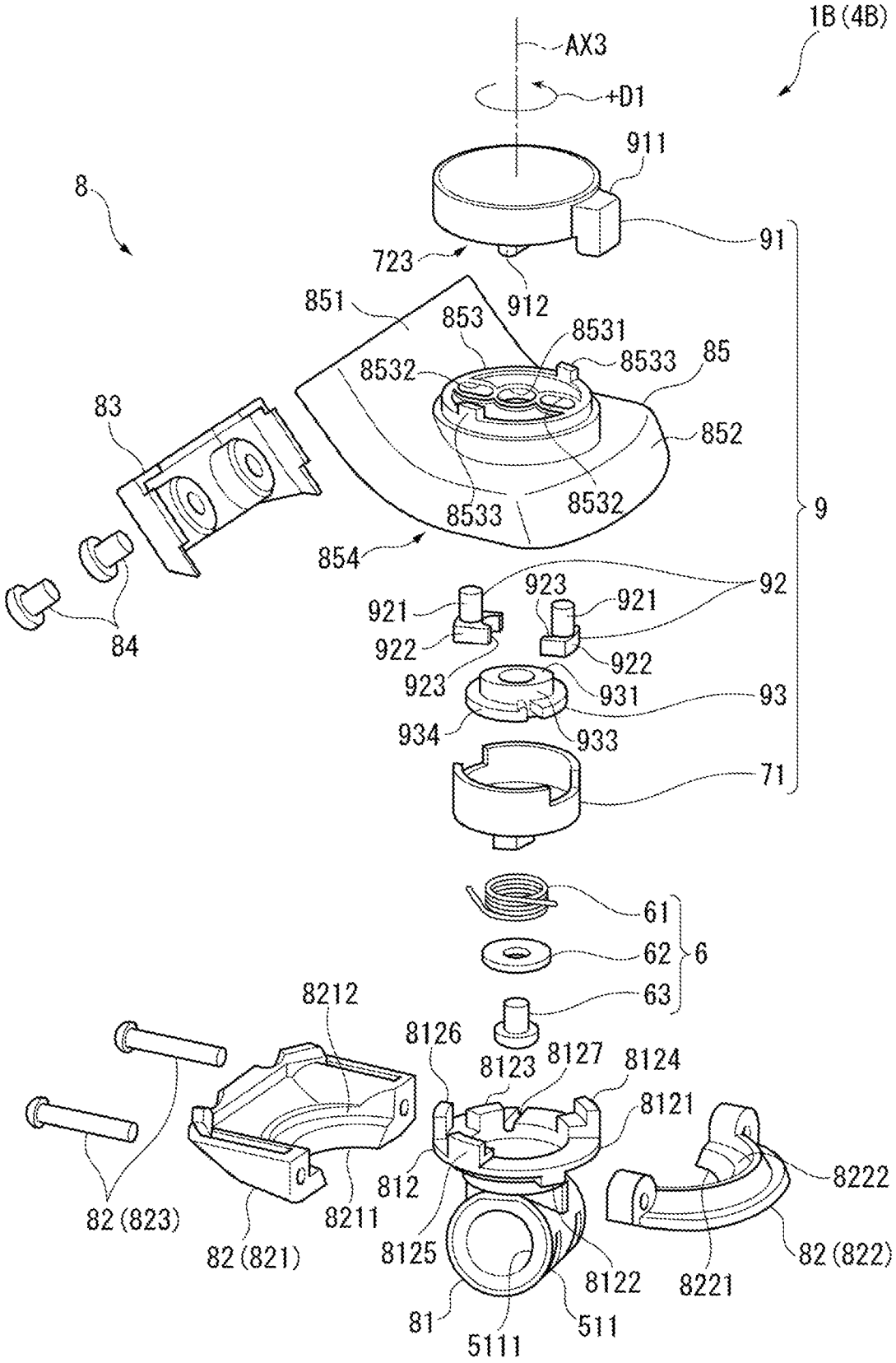
FIG. 17 is an exploded perspective view showing a structure of a connector of a headphone according to a third exemplary embodiment of the invention.

FIG. 17 is an exploded perspective view showing a structure of a connector 4B of a headphone 1B according to the third exemplary embodiment.

The headphone 1B according to the third exemplary embodiment is structurally and functionally the same as the headphone 1 except for a pair of connectors 4B, which are provided in place of the pair of connectors 4.

Each of the connectors 4B is provided to corresponding one of the right and left ends of the headband 2 in the same manner as the connectors 4 and are configured to support corresponding one of the sound emitters 3 (hangers 34) so that the sound emitters 3 are rotatable around the rotation axis AX3 along the top-bottom direction, thereby connecting the headband 2 and the sound emitters 3. As shown in FIG. 17, each of the connectors 4B includes a support 8, the restoring portion 6, and a switcher 9.

It should be noted that the connector 4B located on the left side and the connector 4B located on the right side with respect to the headband 2 are symmetrically arranged but of the same structure in other respects. Accordingly, the connector 4B located on the left side will be described and the description on the connector 4B located on the right side will be omitted hereinbelow.

Structure of Support

As in the support 5, the support 8 is attached to the headband 2 with the hanger 34 being connected, thereby supporting the hanger 34 so that the hanger 34 is rotatable. The support 8 includes a connecting member 81, a first support member 82, a cover 83, a fixing member 84 and a second support member 85.

Structure of Connecting Member

As in the connecting members 51 and 51A, the connecting member 81 is connected to the second connecting portion 342 so that the hanger 34 is rotatable around the rotation axis AX2 (see FIG. 1) along the front-back direction. The connecting member 81 includes the barrel portion 511 at a lower part and a held portion 812 at an upper part.

The held portion 812 includes an annular flange 8121 extending radially outward from the circumference of the held portion 812 to be supported by the first support member 82, and projections 8122 to 8126 and a recess 8127 provided on the flange 8121.

The projection 8122 projects downward from a part of the flange 8121.

The projections 8123 to 8126 project from an upper side of the flange 8121. Among the above, the projection 8123 defines a post for the piece member 71 to be placed thereon. The projection 8124 is configured to be in contact with one and the other of two protrusions 8536, 8537 (see FIG. 18) provided on the second support member 85 when the connecting member 81 is rotated together with the hanger 34, thereby delimiting the rotation range of the connecting member 81. The projection 8125, 8126 are located relatively close to each other at positions opposite the projection 8124 across the center axis of the connecting member 81. A cable connected with the sound-emitting unit 32 of the sound emitter 3 is disposed between the projections 8125, 8126.

The extending portion 612 of the biasing member 61 is inserted into the recess 8127. The biasing force (restoring force) of the biasing member 61 acts on the connecting member 81 via the extending portion 612.

Structure of First Support Member

As in the first support member 52, the first support member 82 includes a first holder piece 821 and a second holder piece 822. The holder pieces 821, 822 are combined via a pair of fixing members 823, which are inserted along a right-left direction and fixed to the second support member 85.

When the headphone 1B is worn by a user, the first holder piece 821 is located at a side facing the user and the second holder piece 822 is located at a side opposite the user. The first holder piece 821 and the second holder piece 822 include semi-circular open portions 8211, 8221, respectively, in which a part of the held portion 812 below the flange 8121 is fitted. In addition, the first holder piece 821 includes a recess 8212 formed along the open portion 8211. The second holder piece 822 includes a recess 8222 formed along the open portion 8221. When the first holder piece 821 and the second holder piece 822 are combined, the held portion 812 of the connecting member 81 is held by the first holder piece 821 and the second holder piece 822 from right and left sides. At this time, a part of the flange 8121 near the first holder piece 821 is received within the recess 8212 and a part of the flange 8121 near the second holder piece 822 is received within the recess 8222. The connecting member 81 is thus rotatably supported by the first support member 82.

Structure of Cover

As in the cover 53, the cover 83 fixes the second support member 85 (extending portion 851) to an end of the headband 2. The fixing member 84 (e.g. a screw) penetrating through the cover 83 and the headband 2 is fixed to the second support member 85, thereby fixing the cover 83 and the second support member 85 to the end of the headband 2.

Though not illustrated, the cover 83 also has holes for receiving the fixing members 84.

Structure of Second Support Member

As in the second support members 55 and 55A, the second support member 85 is attached to the end of the headband 2. The first support member 82 holding the connecting member 81 is attached to the second support member 85. As in the second support member 55, the second support member 85 includes the extending portion 851 and a bent portion 852.

An arrangement base 853, which is provided on the bent portion 852, includes a hole 8531 and a pair of guides 8532 as in the arrangement base 553. In addition, the arrangement base 853 includes a pair of defining portions 8533 projecting at positions symmetric with respect to the hole 8531, the defining portions 8533 delimiting the rotation range of the operation member 91.

Figure 18:
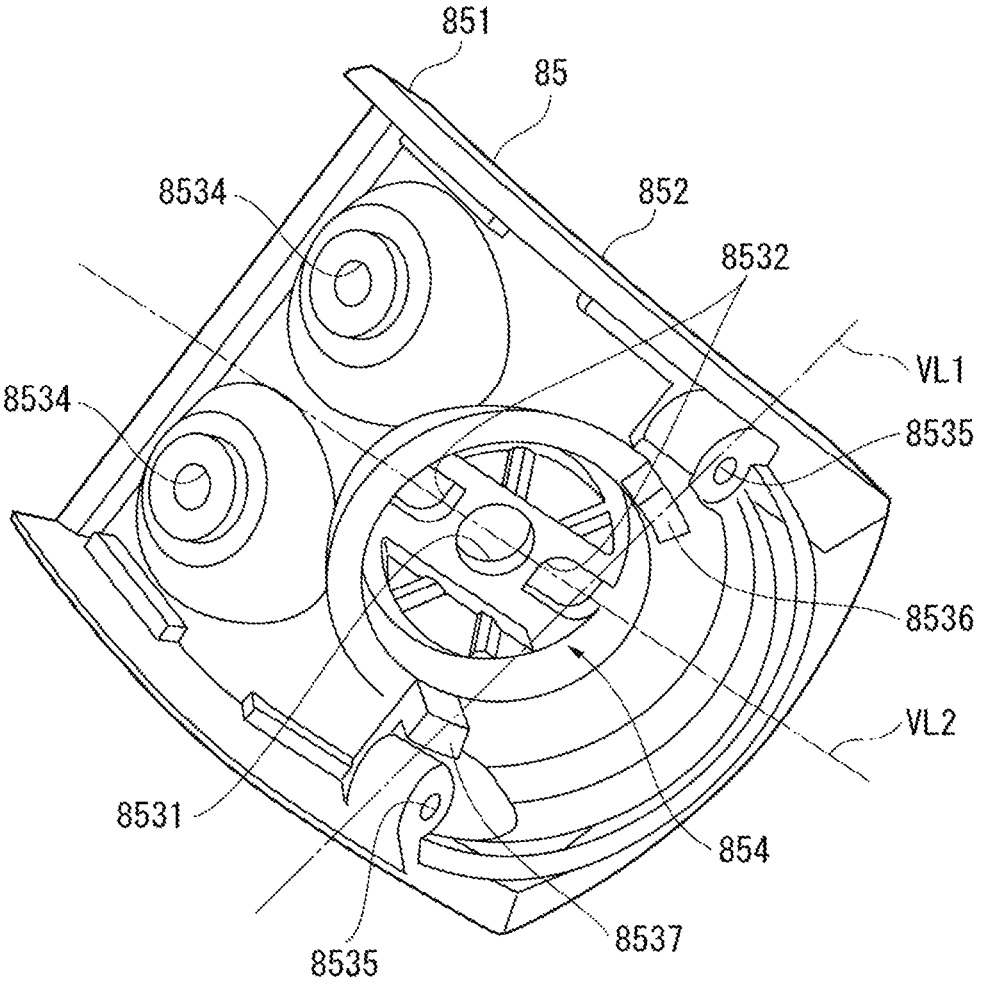
FIG. 18 is a perspective view showing a second support member according to the third exemplary embodiment as viewed from below.

FIG. 18 is a perspective view showing the second support member 85 (bent portion 852) from below.

As shown in FIG. 18, the second support member 85 includes screw holes 8534, 8535, and two protrusions 8536, 8537 as well as a receiver 854, which is recessed in the same manner as the receiver 554 on a surface opposite the arrangement base 853 (i.e. a surface facing the first support member 82).

The number of the screw holes 8534, in which each of the fixing members 84 is fixed, is two in the third exemplary embodiment.

The number of the screw holes 8535, through which the pair of fixing members 823 having penetrated through the holder pieces 821, 822 of the first support member 82 are fixed, is two in the third exemplary embodiment.

The protrusions 8536, 8537 are disposed so that an imaginary line VL1 connecting the protrusions 8536, 8537 intersects an imaginary line VL2 connecting the pair of guides 8532. Further, the protrusions 8536, 8537 are disposed to be located outside the piece member 71 of the switcher 9 when the second support member 85 is combined with the switcher 9. The projection 8124 is located between the protrusions 8536, 8537.

When the sound emitter 3 is rotated in a first direction, the projection 8124 is in contact with one of the protrusions 8536, 8537 at a first terminal end of the rotation range of the sound emitter 3.

When the sound emitter 3 is rotated in a second direction, the projection 8124 is in contact with the other of the protrusions 8536, 8537 at a second terminal end of the rotation range of the sound emitter 3.

Thus, the rotation range of the sound emitter 3 is defined by the positions for the projection 8124 to be in contact with one and the other of the protrusions. When the projection 8124 is in contact with one of the protrusions, the sound emitter 3 is located at the reference position and, when the projection 8124 is in contact with the other of the protrusions, the sound emitter 3 is oriented so that the sound-emitting surface 3S faces the rear side in the third exemplary embodiment.

Structure of Switcher

As in the switchers 7, 7A, the switcher 9 is configured to switch the enabled state in which the restoring portion 6 is enabled to allow the restoring force to act on the connecting member 81 (and consequently on the hanger 34) and the disabled state in which the restoring portion 6 is disabled to keep the restoring force from acting on the connecting member 81. As shown in FIG. 17, the switcher 9 includes the piece member 71, the operation member 91, a pair of restricting members 92, and an intermediate member 93. It should be noted that the switcher of the invention is also defined by a combination of the switcher 9 and the second support member 85 in the third exemplary embodiment.

Among the above, the operation member 91 is located above the second support member 85, and the pair of restricting members 92, the intermediate member 93, and the piece member 71 are located below the second support member 85.

Structure of Operation Member

As in the operation member 72, the operation member 91, which is attached to the arrangement base 853 in a manner rotatable around the rotation axis AX3, is a drive member for moving the pair of restricting members 92. Specifically, the operation member 91 that is in a form of a dial is configured to, in response to a rotary movement applied by a user, move the pair of restricting members 92 in an orthogonal direction orthogonal to the rotation axis AX3 (i.e. in a radial direction of the piece member 71) and rotate the intermediate member 93 in the same direction as the rotation of the operation member 91 to cause the movement of the pair of restricting members 92 in the orthogonal direction.

The operation member 91 includes a knob 911 projecting from an outer circumferential surface of the operation member 91 and configured to be operated by a user. In addition, though not illustrated in detail, the operation member 91 includes a projection 912 projecting from the center of a bottom side to be inserted into the later-detailed intermediate member 93, and the pair of guide grooves 723 symmetrical with respect to the projection 912.

Structure of Restricting Member

Figure 19:
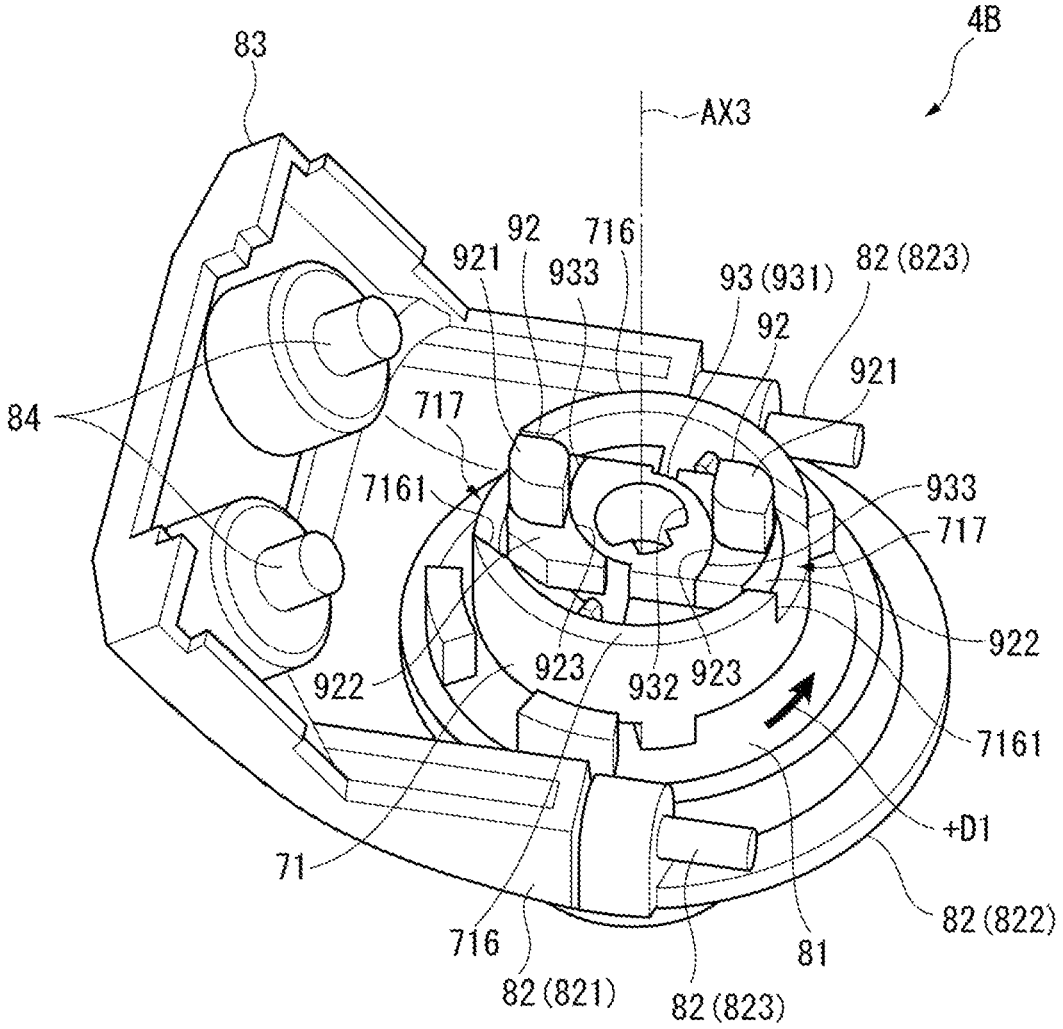
FIG. 19 is a perspective view showing a positional relationship of a piece member, restricting members, and an intermediate member in the third exemplary embodiment.
Figure 20:
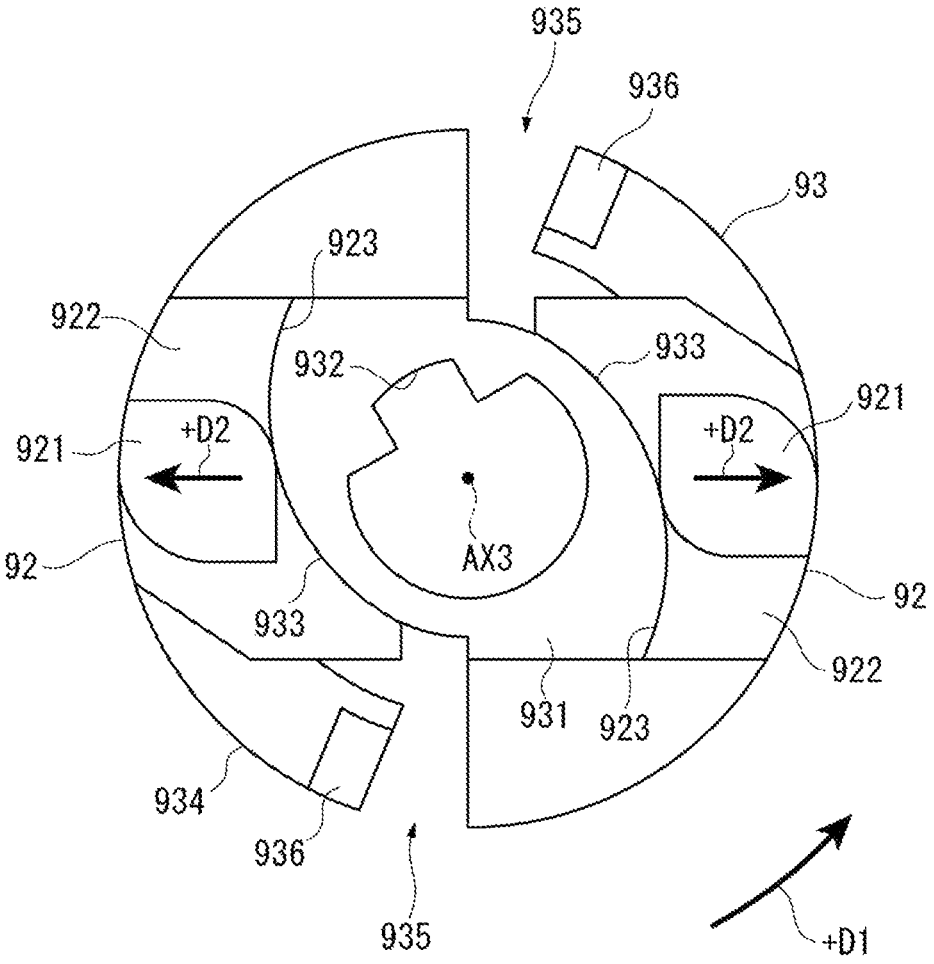
FIG. 20 shows the restricting members and the intermediate member in the third exemplary embodiment as viewed from above.

FIG. 19 is a perspective view showing a positional relationship between the piece member 71, the pair of restricting members 92, and the intermediate member 93. FIG. 20 illustrates the pair of restricting members 92 and the intermediate member 93 as viewed from above. It should be noted that the restricting members 92 are disposed inside the rising portions 716 in FIGS. 19 and 20.

As in the pair of restricting members 76, the pair of restricting members 92 move in the radial directions of the piece member 71 in response to the rotation of the operation member 91, restricting the rotation of the piece member 71. As shown in FIGS. 19 and 20, each of the restricting members 92 is an integrated component including a boss 921, a restricting portion 922, and a curved portion 923.

The boss 921 corresponds to the engagement portion of the invention. Each of the bosses 921 is inserted through corresponding one of the guides 8532 of the second support member 85 to be received in the corresponding one of the guide grooves 723 of the operation member 91.

The restricting portions 922, which are each provided under the corresponding boss 921, are moved toward an inside and outside of the cutouts 717 together with the movement of the restricting members 92.

The curved portion 923 is a part of each of the restricting portions 922 facing corresponding one of push portions 933 of the intermediate member 93, which is located between the restricting members 92. The curved portion 923 has a curved profile conforming to the profile of corresponding one of the push portions 933 and is configured to be pushed by the corresponding one of the push portions 933 in accordance with the rotation of the intermediate member 93. Each of the restricting members 92, whose boss 761 is engaged with the operation member 91, is thus moved in the +D2 direction in accordance with the rotation of the operation member 91 in the +D1 direction, and also moved in the +D2 direction by the pushing force applied by the intermediate member 93.

Structure of Intermediate Member

The intermediate member 93 is configured to be rotated integrally with the operation member 91 to move the restricting members 92 in the +D2 direction (i.e. outward in the radial direction). As shown in FIGS. 19 and 20, the intermediate member 93 includes a cylindrical portion 931, a hole 932, two push portions 933, a flange 934, two cutouts 935, and two projections 936.

The cylindrical portion 931, which define an upper part of the intermediate member 93, is in a form of a substantially elliptical cylinder. The cylindrical portion 931 is located at a position to be held by the restricting members 92.

The hole 932 is provided on an upper side of the cylindrical portion 931. The projection 912 (see FIG. 17) of the operation member 91 is inserted into the hole 932, thereby integrally attaching the intermediate member 93 with the operation member 91.

Each of the two push portions 933, which are defined by curves at parts of lateral face of the cylindrical portion 931 facing the respective restricting members 92, is configured to push the curved portion 923 of each of the restricting members 92. The curved profile of each of the push portions 933 is designed so that the movement of each of the restricting members 92 caused by the push portions 933 is synchronized with (i.e. in the same moving speed and movement direction as) the movement of the restricting members 92 along the corresponding guide grooves 723 in accordance with the rotation of the operation member 91.

The flange 934, which define a lower part of the intermediate member 93, is in a form of a circle having an outer diameter larger than the cylindrical portion 931. The flange 934 is interposed between the upper side 71US of the piece member 71 and the restricting members 92.

The cutouts 935 divide the flange 934 into two parts. The projections 936 are provided on respective ends of the divided parts of the flange 934.

Switching Enabling and Disabling of Restoring Portion by Switcher

Figure 21:
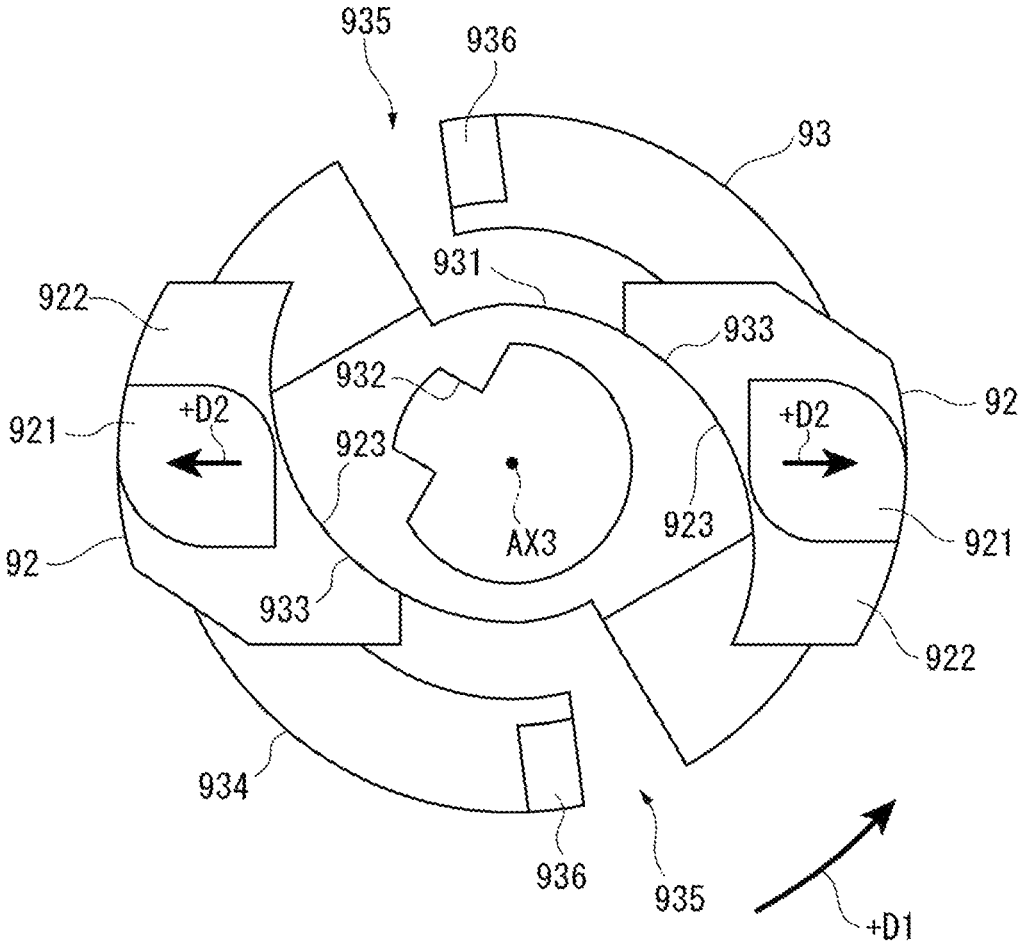
FIG. 21 shows a rotated state of the restricting members and the intermediate member in the third exemplary embodiment.

FIG. 21 illustrates the rotated states of the restricting members 92 and the intermediate member 93 when the operation member 91 is rotated in the +D1 direction as viewed from above.

When the operation member 91 is rotated in the +D1 direction from the state where the restricting members 92 are located inside the rising portions 716 as shown in FIGS. 19 and 20, the bosses 921 received in the respective guide grooves 723 of the operation member 91 are moved in the +D2 direction along the guides 8532 of the second support member 85, as shown in FIG. 21. Together with the movement of the bosses 921, the intermediate member 93 is rotated in the +D1 integrally with the operation member 91 to cause the push portions 933 to push the respective curved portions 923 and move the restricting portions 922 in the +D2 direction.

As described above, the shapes of the guide grooves 723, the curved portions 923, and the push portions 933 are designed so that the moving speed of the bosses 921 in the +D2 direction becomes substantially the same as the moving speed of the restricting portions 922 in the +D2 direction. Thus, the restricting members 92 is restrained from inclining with respect to the +D2 direction and a large load is restrained from being applied on the bosses 921.

Figure 22:
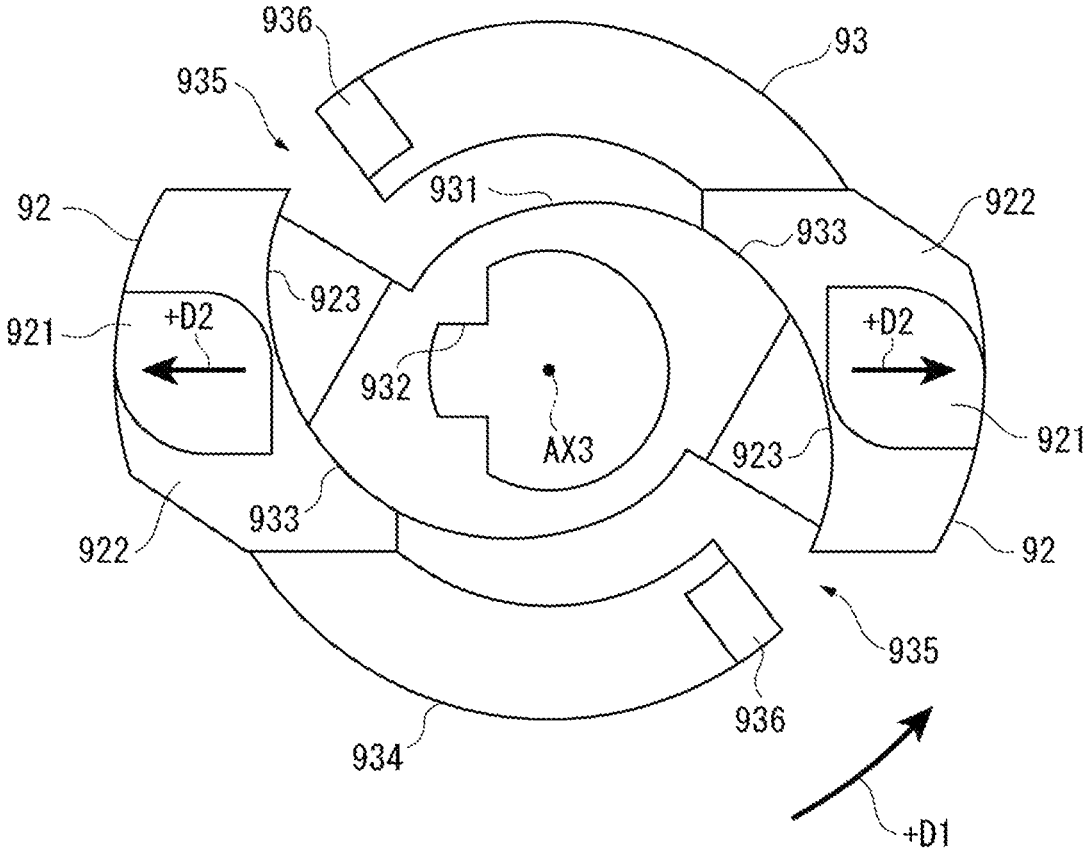
FIG. 22 shows another rotated state of the restricting members and the intermediate member in the third exemplary embodiment.
Figure 23:
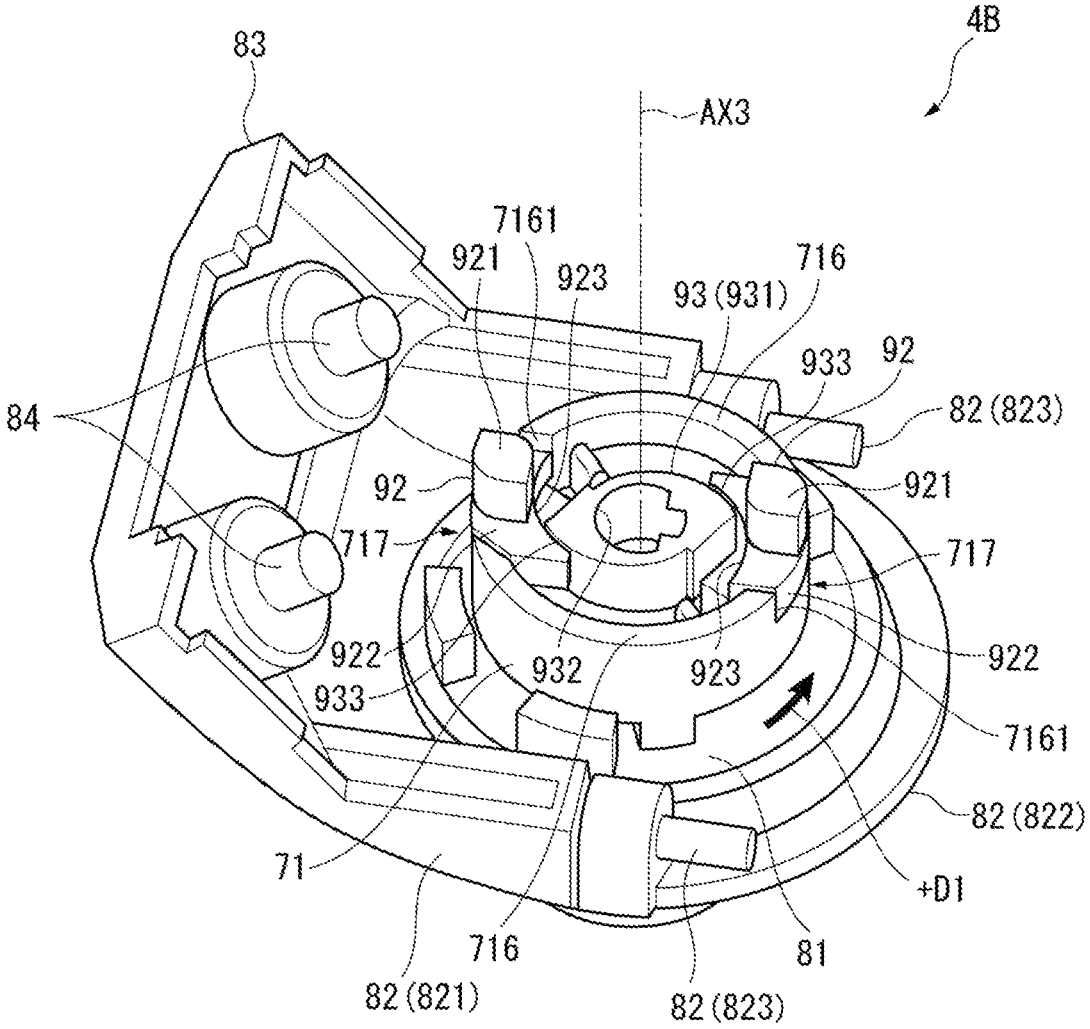
FIG. 23 is a perspective view showing positons of the restricting members and the intermediate member with respect to the piece member in the third exemplary embodiment.

FIG. 22 shows the rotated states of the restricting members 92 and the intermediate member 93 when the operation member 91 is fully rotated in the +D1 direction as viewed from above. FIG. 23 is a perspective view showing the positions of the restricting members 92 and the intermediate member 93 as shown in FIG. 22 with respect to the piece member 71.

When the operation member 91 is fully rotated in the +D1 direction from the rotated state as shown in FIG. 21, the restricting members 92 are further moved in the +D2 direction to reach the terminal end of the movement range of the restricting members 92 as shown in FIG. 22. At this time, the restricting portions 922 of the restricting members 92 are received in the cutouts 717 as shown in FIG. 23, thereby allowing the restricting portions 922 to be in contact with the respective abutment portions 7161. The rotation of the piece member 71 around the rotation axis AX3 is thus restricted, and the state of the restoring portion 6 is switched to the enabled state where the biasing force (restoring force) of the biasing member 61 is capable of acting on the connecting member 81 as in the connectors 4, 4A.

Meanwhile, when the operation member 91 is rotated in an opposite direction to the +D1 direction from the state shown in FIGS. 22 and 23, the restricting members 92 move in an opposite direction to the +D2 direction along the guide grooves 723 of the operation member 91, so that the restricting members 92 are located inside the pair of rising portions 716 as shown in FIG. 19. The restriction on the rotation of the piece member 71 is thus cancelled to allow the rotation of the piece member 71 together with the connecting member 81, thereby switching the state of the restoring portion 6 to the disabled state where the biasing force (restoring force) of the biasing member 61 is incapable of acting on the connecting member 81.

Restriction of Operation Member by Intermediate Member

Without the intermediate member 93, the following problem could occur.

The restricting members 92 are movable so that the restricting portions 922 are received in the respective cutouts 717, as long as the cutouts 717 of the piece member 71 are located in the +D2 direction when the restricting members 92 are moved in the +D2 direction. However, if the cutouts 717 are not located in the +D2 direction as a result of the rotation of the piece member 71 together with the connecting member 81, the restricting portions 922 would be in contact with the inner sides of the rising portions 716 even when the operation member 91 is rotated, thereby restricting the movement of the restricting members 92 in the +D2 direction.

If the operation member 91 is further rotated while the movement of the restricting members 92 in the +D2 direction is restricted by the rising portions 716 as described above, the pushing force for urging the restricting members 92 in the +D2 direction would be applied solely on the bosses 921. Thus, when the bosses 921 are not rigid enough, the bosses 921 might be deformed or damaged.

In contrast, the push portion 933 of the intermediate member 93 in the third exemplary embodiment urges the restricting members 92 to move at substantially the same moving speed as the moving speed of the restricting members 92 caused by the guide grooves 723 of the operation member 91 in response to the rotation of the operation member 91. The pushing force caused by the rotation of the operation member 91 thus acts on the boss 921 and the curved portion 923 (restricting portion 922) of each of the restricting members 92. The pushing force acting on the restricting members 92 is thus distributed to the respective parts. Accordingly, the connector 4B, which is complicated in structure than the connector 4 due to the additional intermediate member 93, can reduce deformation and/or damage on the restricting members 92.

Advantage(s) of Third Exemplary Embodiment

The headphone 1B according to the third exemplary embodiment as described above can achieve not only the same advantages as those of the headphone 1 but also the following advantages.

The switcher 9 includes the intermediate member 93 rotatable in accordance with the operation member 91 in a form of a dial. The intermediate member 93 includes the push portions 933 configured to push the restricting members 92 in a direction for the restricting members 92 to be moved in accordance with the rotation of the operation member 91. With the above arrangement, even when the operation member 91 is further moved in the +D1 direction while the cutouts 717 are not present in the +D2 direction, the load applied on the bosses 921 can be reduced as described above. Accordingly, the deformation and/or damage of the restricting members 92 can be reduced, so that the enabled state and the disabled state of the restoring portion 6 can be reliably switched.

The push portions 933 each have a curved profile as viewed along the rotation axis of the intermediate member 93 (coaxial with the rotation axis AX3) so that the moving speed of the respective restricting members 92 in the +D2 direction in accordance with the rotation of the operation member 91 becomes equal to the moving speed of the respective restricting members 92 in the +D2 direction by the intermediate member 93. The pushing force applied on the bosses 921 by the guide grooves 723 of the operation member 91 can thus be equalized with the pushing force applied to the curved portions 923 by the intermediate member 93, thereby reliably distributing the pushing force acting on the restricting member 92. Accordingly, the deformation and/or damage on the restricting members 92 can be reliably reduced.

Fourth Exemplary Embodiment

Next, a fourth exemplary embodiment of the invention will be described.

A headphone according to the fourth exemplary embodiment is structurally the same as the headphone 1B except that the restricting member is provided between the second support member and the operation member. It should be noted that the same or substantially the same parts as already described will be denoted by the same reference characters hereinbelow for omission of the description thereof.

Figure 24:
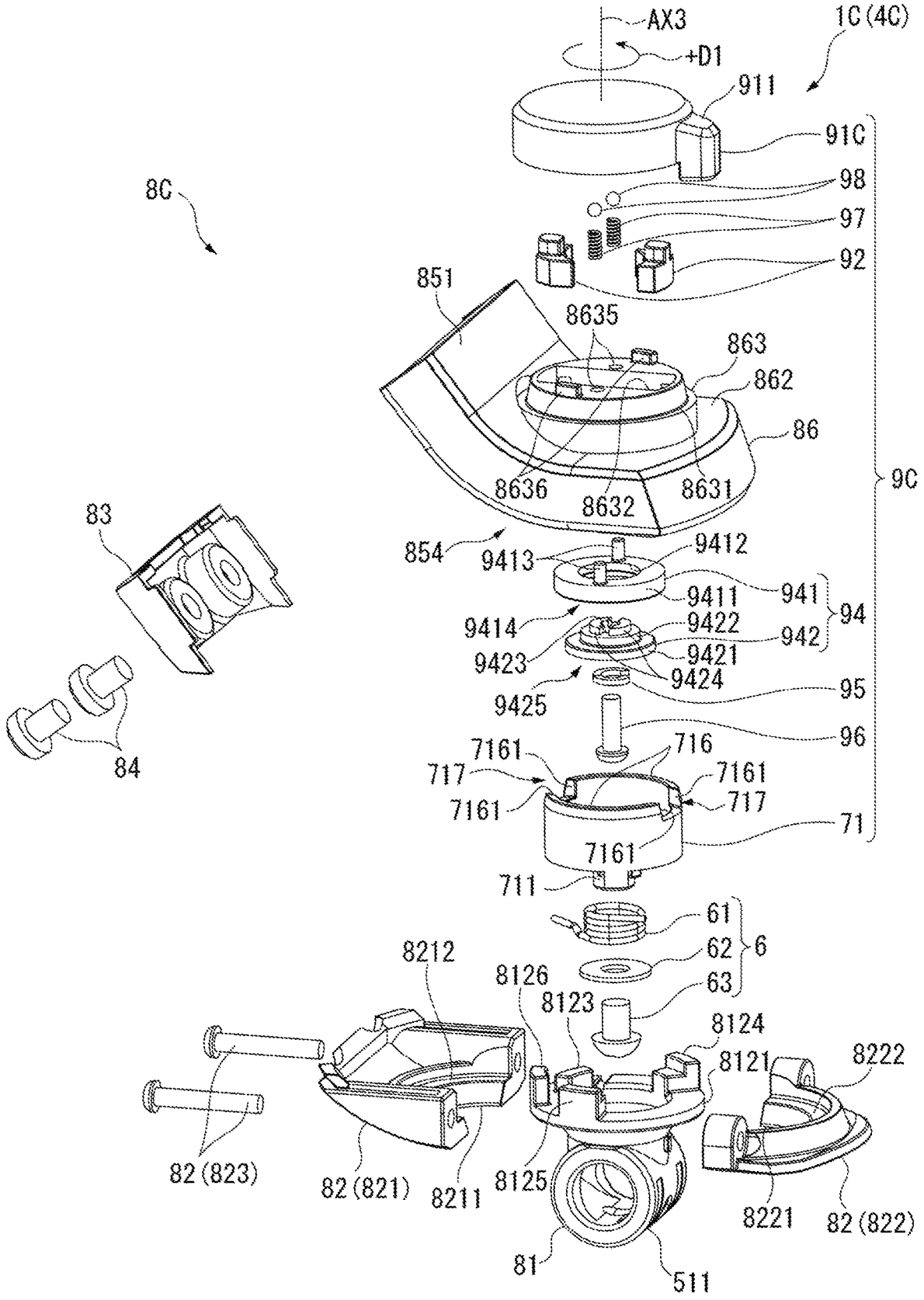
FIG. 24 is an exploded perspective view showing a structure of a connector of a headphone according to a fourth exemplary embodiment of the invention.

FIG. 24 is an exploded perspective view showing a structure of a connector 4C of a headphone 1C according to the fourth exemplary embodiment.

The headphone 1C according to the fourth exemplary embodiment is structurally and functionally the same as the headphone 1B except for a pair of connectors 4C, which are provided in place of the pair of connectors 4B.

Each of the connectors 4C is provided to corresponding one of the right and left ends of the headband 2 in the same manner as the connectors 4, 4A, 4B and are configured to support corresponding one of the sound emitters 3 (hangers 34) so that the sound emitters 3 are rotatable around the rotation axis AX3 along the top-bottom direction, thereby connecting the headband 2 and the sound emitters 3. As shown in FIG. 24, each of the connectors 4C includes a support 8C, the restoring portion 6, and a switcher 9C.

It should be noted that the connector 4C located on the left side and the connector 4C located on the right side with respect to the headband 2 are symmetrically arranged but of the same structure in other respects. Accordingly, the connector 4C located on the left side will be described and the description on the connector 4C located on the right side will be omitted hereinbelow.

Structure of Support

As in the supports 5, 5A and 8, the support 8C is attached to the headband 2 with the hanger 34 being connected, thereby supporting the hanger 34 and, consequently, the sound emitter 3 so that the hanger 34 and the sound emitter 3 are rotatable. The support 8C is structurally and functionally the same as the support 8 except that the support 8C includes a second support member 86 in place of the second support member 85.

Structure of Second Support Member

Figure 25:
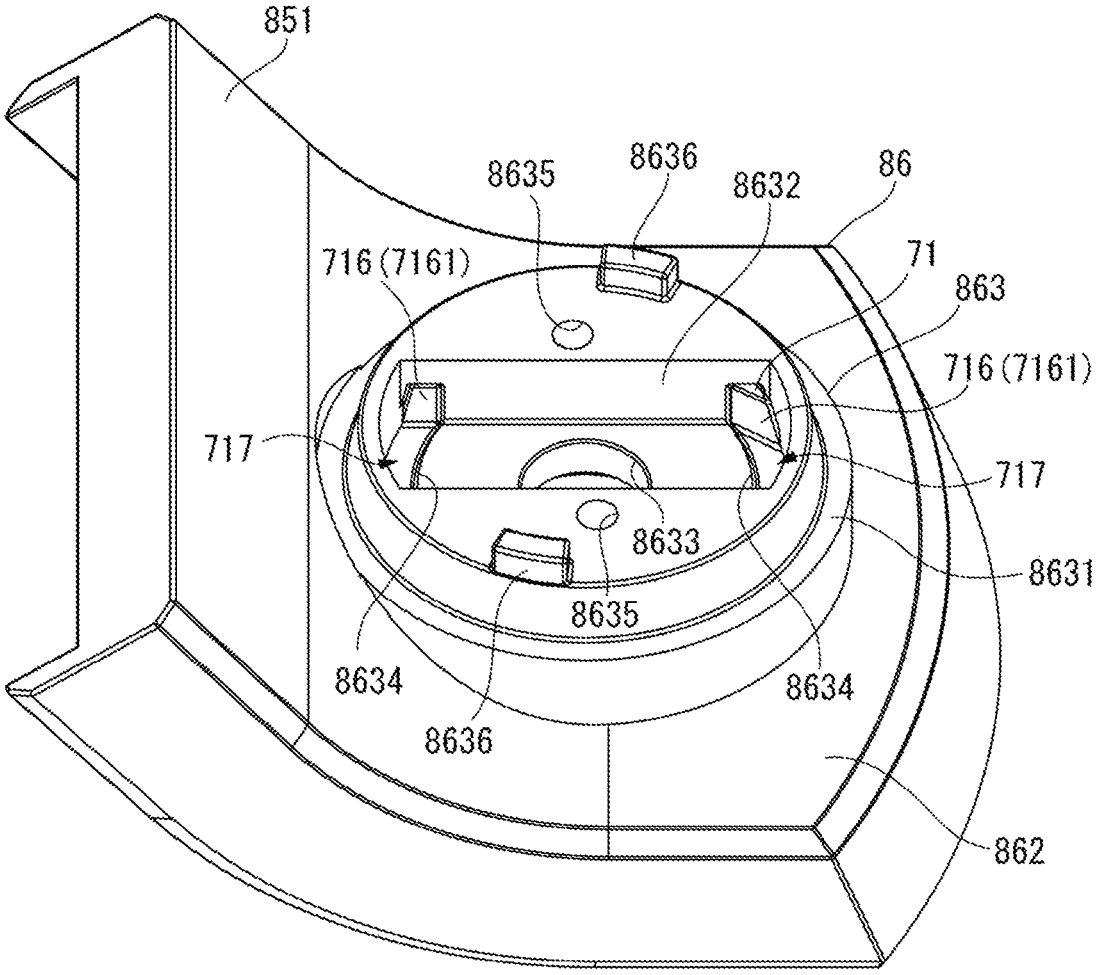
FIG. 25 is a perspective view showing a second support member according to the fourth exemplary embodiment as viewed from above.

FIG. 25 is a perspective view showing the second support member 86 as viewed from above. Specifically, FIG. 25 is a perspective view showing the second support member 86 combined with the piece member 71 as viewed from above.

As in the second support members 55, 55A and 85, the second support member 86 is attached to an end of the headband 2. The first support member 82 holding the connecting member 81 is attached to the second support member 86. As shown in FIGS. 24 and 25, the second support member 86 includes the extending portion 851 and a bent portion 862 bent at an end of the extending portion 851 to extend substantially in the right-left direction.

The bent portion 862 includes an arrangement base 863, on which an operation member 91C (described later) is placed. The arrangement base 863 is a two-stage cylindrical upward projection of a profile corresponding to an outer profile of the operation member 91C. Thus, a step portion 8631 is formed along a periphery of the arrangement base 863. The step portion 8631 is covered with the operation member 91C.

In addition, the arrangement base 863 includes a guide 8632, an insertion hole 8633, a pair of cuts 8634, a pair of holes 8635, and a pair of protrusions 8636 as shown in FIG. 25.

The guide 8632 is a substantially rectangular recess extending diametrically in the arrangement base 863 as viewed from above. The insertion hole 8633 is provided at the bottom of the guide 8632 at a position corresponding to the center of the arrangement base 863. The restricting members 92 are received in the guide 8632. In addition, a projection 915 and push portions 916 of the operation member 91C (see FIGS. 26 and 27) are disposed in the guide 8632 when the operation member 91C is placed on the arrangement base 863. In other words, the guide 8632 is configured to guide a linear movement of the restricting members 92 in accordance with the rotation of the operation member 91C.

The pair of cuts 8634 are formed in respective longitudinal ends of the guide 8632. The rising portions 716 and the cutouts 717 of the piece member 71 combined with the second support member 86 are exposed through the pair of cuts 8634.

The pair of holes 8635 are formed outside the guide 8632 across the insertion hole 8633. Each of the pair of holes 8635 vertically penetrates through the second support member 86. A later-described ball 98 is received in each of the holes 8635.

The pair of protrusions 8636 are formed near an outer periphery with respect to the pair of holes 8635 across the insertion hole 8633. The pair of protrusions 8636 are formed so that an imaginary line (not shown) connecting the protrusions 8636 and an imaginary line (not shown) connecting the pair of holes 8635 intersect each other. The protrusions 8636 are received in respective restricting grooves 918 (see FIGS. 26 and 27) of the operation member 91C placed on the arrangement base 863 to define a rotation range of the operation member 91C.

In addition, the bent portion 862 is provided with a receiver 854 in a form of a recess on a surface opposite the arrangement base 863 (i.e. the surface facing the first support member 82) as shown in FIG. 24, as well as the screw holes 8534, 8535 and the protrusions 8536, 8537 (not shown).

Structure of Switcher

As in the switchers 7, 7A and 9, the switcher 9C is configured to switch the enabled state in which the restoring portion 6 is enabled to allow the restoring force to act on the connecting member 81 (and consequently on the sound emitter 3) and the disabled state in which the restoring portion 6 is disabled to keep the restoring force from acting on the connecting member 81. As shown in FIG. 24, the switcher 9C includes the operation member 91C, an intermediate member 94, an O-ring 95, a fixing member 96, biasing members 97, and the balls 98 as well as the above-described piece member 71 and the pair of restricting members 92 as shown in FIG. 24.

The fixing member 96 in the fourth exemplary embodiment is a screw. The pair of restricting members 92 are received in the guide 8632 across the rotation axis of the piece member 71 (coaxial with the rotation axis AX3), as described above.

Structure of Operation Member

Figure 26:
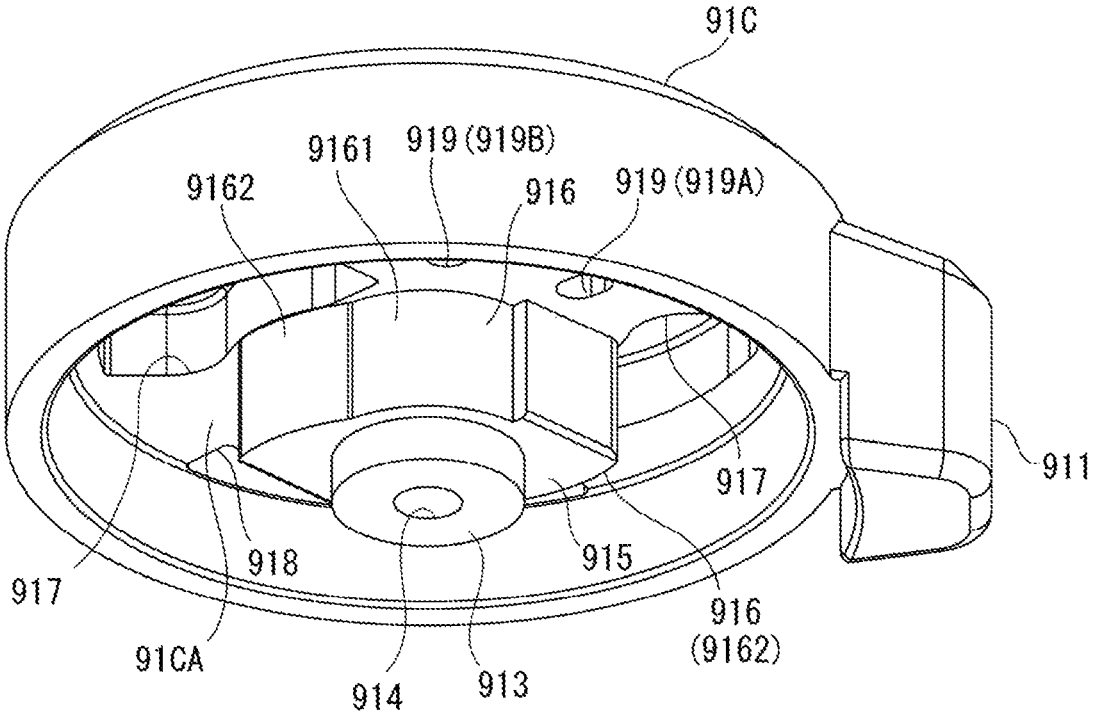
FIG. 26 is a perspective view showing an operation member according to the fourth exemplary embodiment as viewed from below.
Figure 27:
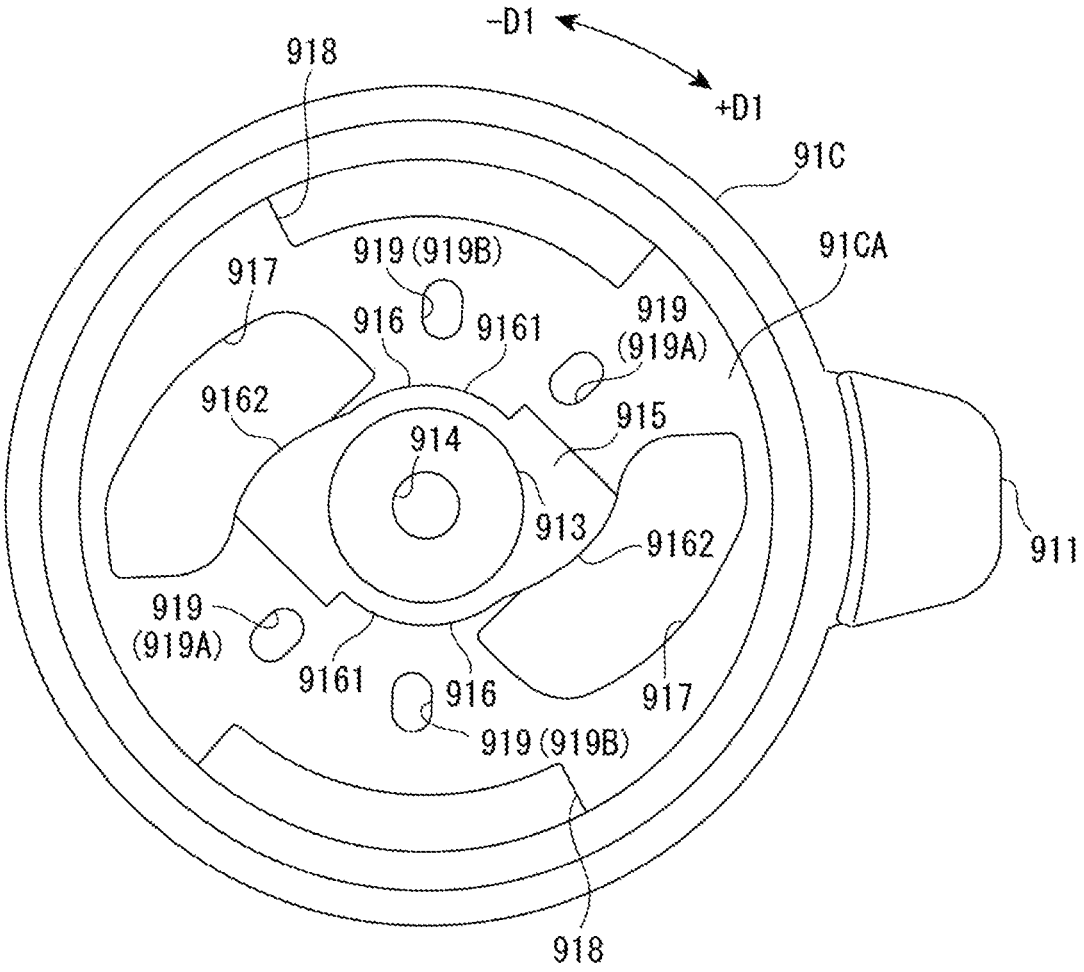
FIG. 27 shows an operation member according to the fourth exemplary embodiment as viewed from below.

FIGS. 26 and 27 are a perspective view and a bottom view, respectively, showing the operation member 91C from below. It should be noted that one of the pair of restricting grooves 918 and two of the four holes 919 of the operation member 91C are shown in FIG. 26 for the convenience of illustration.

As in the operation member 91, the operation member 91C, which is attached to the arrangement base 863 in a manner rotatable around the rotation axis AX3, is a drive member in a form of a dial for moving the pair of restricting members 92 in the fourth exemplary embodiment. As shown in FIGS. 26 and 27, the operation member 91C has a bottomed cylindrical shape placed upside down. The operation member 91C includes the laterally-projecting knob 911, a boss 913, a screw hole 914, the projection 915, the pair of push portions 916, a pair of guide grooves 917, the pair of restricting grooves 918, and the four holes 919.

The boss 913 is a substantially cylindrical component projecting at a center of an inner surface 91CA defining the bottom of the bottomed cylindrical shape of the operation member 91C. When the operation member 91C is placed on the arrangement base 863, the boss 913 penetrates through the insertion hole 8633 to be exposed at a lower side of the second support member 86.

The screw hole 914 is formed at an end surface (bottom side) of the boss 913. The fixing member 96 for fixing the later-described intermediate member 94 to the boss 913 is secured to the screw hole 914.

The projection 915, which is a substantially elliptical cylinder projecting from a lateral surface of the boss 913, is received in the guide 8632 of the arrangement base 863.

The pair of push portions 916, which are defined at parts of the projection 915 opposite each other, are configured to push and move the pair of restricting members 92 (also received in the guide 8632) in mutually separating directions when the operation member 91C is rotated. As in the push portions 933 of the intermediate member 93, the pair of push portions 916 each have a curved profile. Specifically, the push portions 916 are defined by curved surfaces so that the moving speed of the restricting members 92 in a certain direction caused by the later-described guide groove 917 in accordance with the rotation of the operation member 91C becomes substantially equal to the moving speed of the restricting members 92 in the certain direction being pushed by the pair of push portions 916.

Specifically speaking, the push portions 916, which are each defined by an arc as a whole, are each divided into a first pushing portion 9161 and a second pushing portion 9162 substantially at a half in a circumferential direction of each of the push portions 916. Though not illustrated, the center of curvature of the first pushing portion 9161 is located at the center of the screw hole 914, whereas the center of curvature of the second pushing portion 9162 is offset from the center of the screw hole 914. The curved portion 923 of each of the restricting members 92 of the fourth exemplary embodiment is curved in conformity with the profile of the corresponding one of the push portions 916.

The pair of guide grooves 917 are arc-shaped grooves formed in the inner surface 91CA across the boss 913. As in the pair of guide grooves 723, the boss 921 of corresponding one of the restricting members 92 is inserted into each of the pair of guide grooves 917. The restricting members 92 are thus moved in directions toward and away from each other in accordance with the rotation of the operation member 91C.

The pair of restricting grooves 918, which are formed at an outer periphery of the inner surface 91CA, are arc-shaped grooves around the screw hole 914. An angle of the arc of one of the pair of the restricting grooves 918 is the same as an angle of the arc of the other one of the pair of the restricting grooves 918. Each of the protrusions 8636 is received in corresponding one of the pair of restricting groove 918 when the operation member 91C is placed on the arrangement base 863, thereby delimiting the rotation range of the operation member 91C.

Four holes 919 (919A, 919B) are formed in the inner surface 91CA. Two of the four holes 919A are provided on a first imaginary line (not illustrated) passing through the center of the screw hole 914, whereas the other two of the holes 919B are provided on a second imaginary line passing through the center of the screw hole 914 and intersecting the first imaginary line at a predetermined intersection angle (approximately 45 degrees in the fourth exemplary embodiment). The balls 98 provided to the intermediate member 94 are fittable in the holes 919.

Structure of Intermediate Member

As shown in FIG. 24, the intermediate member 94 is disposed inside the pair of rising portions 716 of the piece member 71. The fixing member 96 having passed through the O-ring 95 is inserted into the intermediate member 94 to be fixed in the screw hole 914 exposed at a lower side through the insertion hole 8633. The intermediate member 94 is thus integrated with the operation member 91C with the second support member 86 interposed therebetween. In other words, the second support member 86 and the pair of restricting members 92 are held by the intermediate member 94 and the operation member 91C to keep the pair of restricting members 92 from dropping off.

The intermediate member 94 includes a first intermediate member 941 and a second intermediate member 942.

The first intermediate member 941, which is a support member for supporting the biasing members 97 and the balls 98, is combined with the second intermediate member 942 fixed to the screw hole 914 (i.e. to the operation member 91C). The first intermediate member 941 includes an annular body 9411 defining a circular opening 9412, a pair of pins 9413 projecting from an upper side of the body 9411, and a recess 9414.

An insertion portion 9422 of the second intermediate member 942 is inserted into the opening 9412. Accordingly, the first intermediate member 94 is not rotated even when the second intermediate member 942 is rotated integrally with the operation member 91C.

The pair of pins 9413 project across the opening 9412. The biasing member 97 in a form of a compression coil spring is provided at an end of each of the pair of pins 9413. The balls 98 are each provided at an end of the biasing member 97. The balls 98 are exposed from an upper side of the arrangement base 863 through the respective holes 8635. When the balls 98 are fitted into the holes 919 in accordance with the rotated state of the operation member 91C placed on the arrangement base 863, a user senses a clicking touch each time the operation member 91C is rotated. The pins 9413 are disposed so that a direction connecting the pins 9413 approximately orthogonally intersects a direction for the pair of restricting members 92 to face each other.

The recess 9414 is at a bottom side of the first intermediate member 941. A body 9421 of the second intermediate member 942 is fitted into the recess 9414.

The second intermediate member 942 is a component for attaching the first intermediate member 941 to the operation member 91C. The second intermediate member 942 includes the body 9421, the insertion portion 9422, a through hole 9423, holders 9424 and a recess 9425.

The body 9421, which defines an outer periphery of the second intermediate member 942, is a substantially disc-shaped component. The body 9421 is fitted into the recess 9414.

The insertion portion 9422 is a substantially cylindrical component projecting from an upper side of the body 9421. The insertion portion 9422 is inserted into the opening 9412 of the first intermediate member 941.

The through hole 9423 vertically penetrates through the body 9421 and the insertion portion 9422 along the top-bottom direction. The fixing member 96 is inserted into the through hole 9423 from below.

The holders 9424, which are provided in a pair on an upper side of the insertion portion 9422 across the through hole 9423, hold the fixing member 96 inserted through the through hole 9423. Mutually facing surfaces of the holders 9424 are threaded to be meshed with the fixing member 96 in a form of a screw.

The recess 9425 is provided on a lower side of the body 9421. The O-ring 95 and a head of the fixing member 96 (screw) are received in the recess 9425.

Switching Enabling and Disabling of Restoring Portion by Switcher

Figure 28:
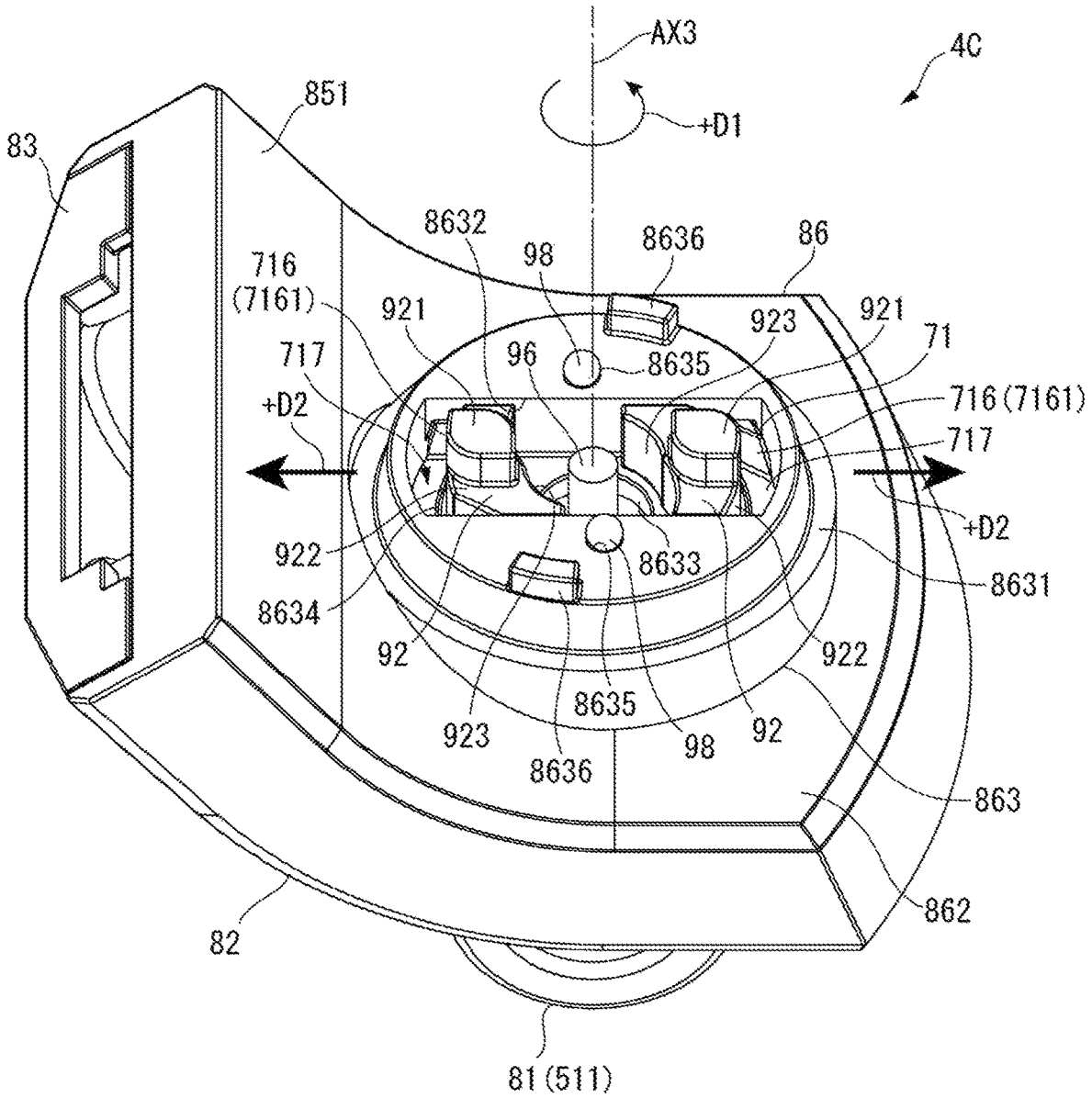
FIG. 28 is a perspective view showing positions of the restricting members when a restoring portion is disabled in the fourth exemplary embodiment as viewed from above.

FIG. 28 is a perspective view as viewed from above showing positions of the pair of restricting members 92 when the restoring portion 6 is disabled. It should be noted that the operation member 91C is not illustrated in FIG. 28 for the convenience of easily understanding the moving state of the restricting members 92.

When the restoring portion 6 is disabled, in other words, when the restoring force of the restoring portion 6 does not act on the connecting member 81, the pair of restricting members 92 are located near the center of the guide 8632 of the second support member 86 as shown in FIG. 28. Specifically, the pair of restricting members 92 are located near the center of the guide 8632 (allowing position) with respect to the pair of cuts 8634 at both longitudinal ends of the guide 8632. Thus, even when the piece member 71 whose rising portions 716 and the cutouts 717 are exposed through the pair of cuts 8634 is rotated, the restricting members 92 are not in contact with the respective abutment portions 7161, so that the rotation of the piece member 71 is not restricted. In this state, since the piece member 71 and the restoring portion 6 are rotated together with the connecting member 81 and the sound emitter 3, the restoring force by the restoring portion 6 is not generated. Thus, irrespective of the rotation of the connecting member 81 and the sound emitter 3, the restoring force (the biasing force of the biasing member 61) does not act on the connecting member 81 and the sound emitter 3.

Figure 29:
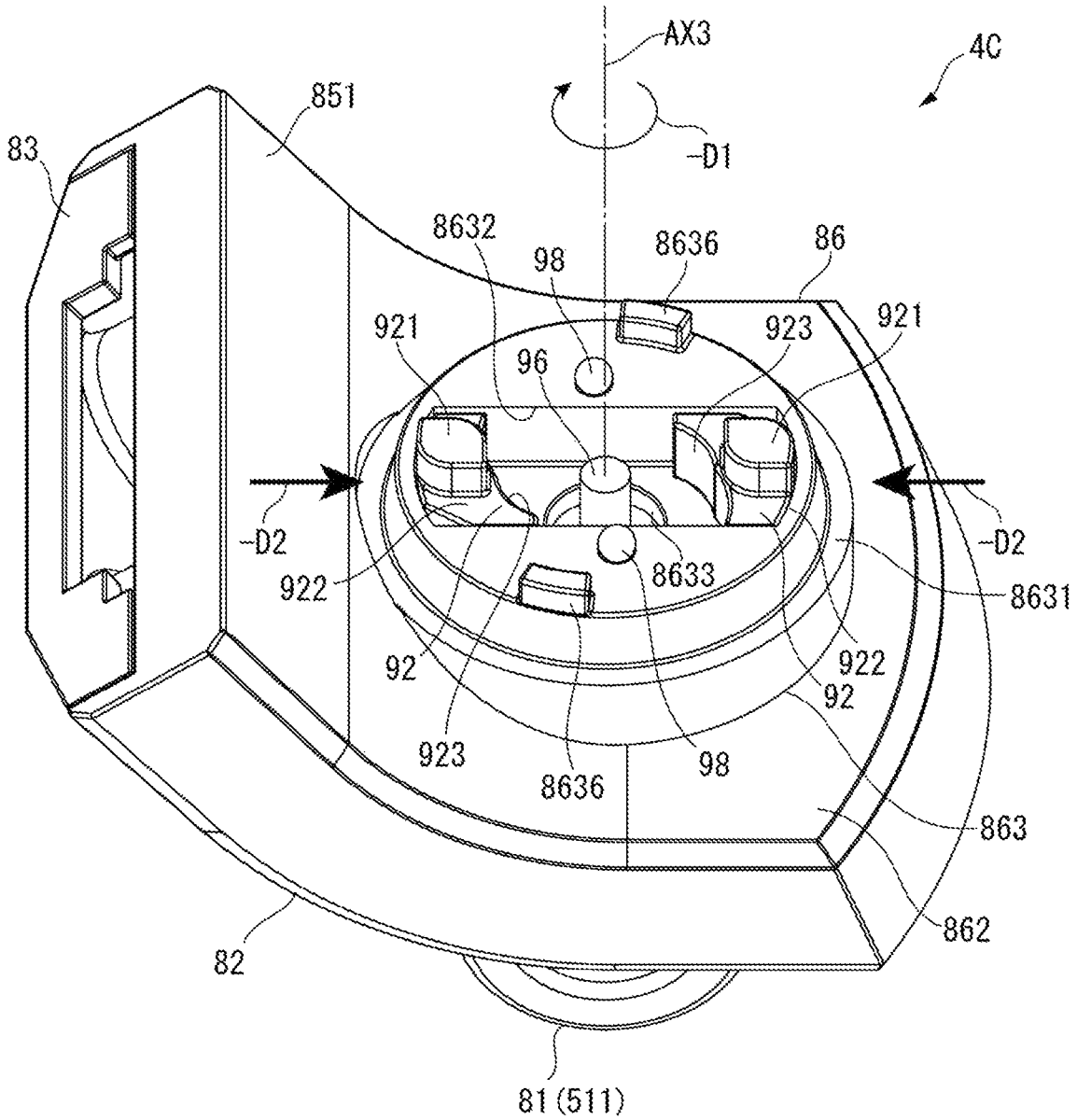
FIG. 29 is a perspective view showing positions of the restricting members when the restoring portion is enabled in the fourth exemplary embodiment as viewed from above.

FIG. 29 is a perspective view as viewed from above showing positions of the restricting members 92 when the restoring portion 6 is enabled. It should be noted that the operation member 91C is also not illustrated in FIG. 29 for the convenience of easily understanding the moving state of the restricting members 92.

When the operation member 91C is rotated in the +D1 direction from the state (disabled state) shown in FIG. 28, the restricting members 92 are moved toward the ends of the guide 8632 (in the +D2 direction) (restricting position) being guided by the guide groove 917 with the bosses 921 being received therein. At this time, the push portions 916 located in the guide 8632 push the curved portion 923 of the respective restricting members 92, so that the restricting members 92 are also moved toward the ends of the guide 8632 (in the +D2 direction). The restricting members 92 are thus located at the ends of the guide 8632 to enable the restoring portion 6 as shown in FIG. 29.

In this enabled state, since the restricting members 92 are located at the respective cutouts 717 of the piece member 71 exposed through the cuts 8634, the rotation of the piece member 71 is, even tried, restricted by the restricting portions 922 that are in contact with the respective abutment portions 7161. Since the piece member 71 and the restoring portion 6 are unable to rotate together with the connecting member 81 and the sound emitter 3, the restoring force by the restoring portion 6 is generated when the connecting member 81 and the sound emitter 3 are rotated. Thus, the restoring force (the biasing force of the biasing member 61) acts on the connecting member 81 and the sound emitter 3 in a direction for urging the sound emitter 3 toward the reference position.

In the enabled state, the protrusions 8636 of the arrangement base 863, which are each located at an end of corresponding one of the restricting grooves 918, restrict the further rotation of the operation member 91C. Further, the balls 98 are fitted in the holes 919B of the operation member 91C to cause the clicking touch in the enabled state. The user can thus easily understand that the operation member 91C is rotated to one of the ends of the rotation range.

When the operation member 91C is rotated in the −D1 direction from the enabled state shown in FIG. 29, the restricting members 92 are moved by the guide groove 917 in the −D2 direction to reach the allowing position. The restoring portion 6 is thus disabled as shown in FIG. 28.

In the disabled state, the protrusions 8636 are located at the other ends of the corresponding restricting grooves 918 to restrict the further rotation of the operation member 91C and, in addition, the balls 98 are fitted in the respective holes 919A to cause the clicking touch. The user can thus easily understand that the operation member 91C is rotated to the end of the rotation range.

Advantage(s) of Fourth Exemplary Embodiment

The headphone 1C according to the fourth exemplary embodiment as described above can achieve not only the same advantages as those of the headphone 1B but also the following advantage.

In the fourth exemplary embodiment, the operation member 91C (dial) includes the push portions 916 configured to push and move the restricting members 92 in the +D2 direction when the operation member 91C is rotated in the +D1 direction. The thickness of the projection 915, on which the push portions 916 are provided, can thus be increased, so that the strength of the component for pushing and moving the restricting members 92 can be enhanced. Accordingly, the operation member 91C can be made not only of a metal (a material of high strength) but also of a synthetic resin, thereby increasing the options for the material of the operation member 91C. Since the operation member 91C made of a synthetic resin can reduce not only the production cost of the operation member 91C (consequently of the headphone 1C) but also the weight of the headphone 1C, the load on the user wearing the headphone 1C can be reduced.

Modification(s)

Incidentally, it should be understood that the scope of the invention is not limited to the above-described exemplary embodiments but includes modifications and improvements that do not hamper the achievement of an object of the invention.

In the exemplary embodiments, the drive member for moving the restricting members 76, 77, 92 is provided by the operation members 72, 91, 91C each in a form of a dial. However, the drive member (operation member) is not necessarily constructed as described above, but may be any component as long as being capable of moving the restricting members 76, 77, 92 to the restricting position and the allowing position. For instance, the operation member is provided by a slide switch or a push switch in some embodiments.

In the exemplary embodiments, the switchers 7, 7A, 9, 9C are configured to restrict the rotation of the piece member 71 connected to the connecting member 51, 81, which are connected to the hanger 34 (sound emitter 3) via the biasing member 61, to switch the enabled state where the biasing force of the biasing member 61 acts on the connecting members 51, 81 and the disabled state where the biasing force of the biasing member 61 does not act on the connecting members 51, 81. However, the switcher is not necessarily constructed as the above, but is configured, in some embodiments, to disconnect (disengage) the biasing member 61 from at least one of the connecting members 51, 81 and the piece member 71 to switch the enabled state to the disabled state. For instance, a clutch is provided in some embodiments between the restoring portion (biasing member) and the connecting member and/or between the restoring portion (biasing member) and the piece member, the clutch being brought into/out of contact with the restoring portion to switch applying the restoring force by the restoring portion or not.

In the first, third and fourth exemplary embodiments, when the restoring portion 6 is disabled, the connecting member 51 and, consequently, the sound emitter 3 is freely rotatable within the rotation range. Alternatively, as in the second exemplary embodiment, the sound emitter 3 is locked at a predetermined angle in some embodiments, thereby enhancing the user-friendliness of the headphone. The structure for locking the sound emitter 3 at the predetermined angle is not necessarily the structure described in the second exemplary embodiment but is differently structured in some embodiments.

In the exemplary embodiments, the restoring portion 6 includes the biasing member 61 in a form of a torsion coil spring. However, the biasing member is not necessarily a torsion coil spring but is other coil spring or a flat spring, or any elastic member capable of applying an elastic force thereof as the restoring force in some embodiments.

In the exemplary embodiments, the sound emitter 3 includes the hanger 34 for supporting the housing 31. However, the invention is not limited thereto and the hanger 34 is not provided in some embodiments. In this case, the housing 31 is directly connected to the connecting member 51 or 81, or may be connected via other component(s).

In the exemplary embodiments, the restricting members 76, 77, 92 are symmetrically arranged with respect to the rotation axis AX3 coaxial with the center axis of the piece member 71. However, the restricting members 76, 77, 92 are not necessarily arranged as the above. A single restricting member is provided to the switcher 7, 7A, 9, or 9C in some embodiments, and three or more restricting members are provided to the switcher 7, 7A, 9, or 9C in some embodiments.

In the third and fourth exemplary embodiments, the restricting members 92 each include the boss 921 to be received in the guide grooves 723 and 917 of the operation members 91 and 91C, respectively, and the curved portion 923 (pushed portion) to be pushed by the push portions 933, 916. However, the above arrangement is not exhaustive, and the boss 921 is not engaged with the operation members 91, 91C in some embodiments as long as the restricting member can be moved in the +D2 direction by the push portion and can be moved in the −D2 direction by, for instance, a biasing member. Further, the boss 921 does not necessarily penetrate through the guide 8532 and project to the outside of the guide 8632 as long as the restricting member can be moved in the +D2 and −D2 directions. In other words, the restricting member is not necessarily provided with the boss to be engaged with the operation member.

In the exemplary embodiments, the sound emitter 3 is connected to the headband 2 through the connectors 4 and 4A to 4C so that the sound emitter 3 is rotatable around the rotation axis AX3 along the top-bottom direction. However, the above arrangement is not exhaustive and the rotation axis AX3 intersects the top-bottom direction in some embodiments. In other words, the rotation axis of the sound emitter 3 does not necessarily extend along the top-bottom direction but may extend in any direction.

In the above exemplary embodiments, the sound emitter 3 is rotatable toward the rear side within a range of 90 degrees with respect to the reference position being 0 degrees. However, the invention is not limited thereto but the maximum rotation angle of the sound emitter 3 can be changed as needed in some embodiments. Specifically, the maximum rotation angle of the sound emitter 3 exceeds 90 degrees (e.g., 180 degrees) in some embodiments. It should be noted that a rotation angle of the sound emitter 3 of 360 degrees or more would cause twist of the cord connected to the sound-emitting unit 32 located in the sound emitter 3, so that the maximum rotation angle is preferably less than 360 degrees.

Further, the reference position is defined at the position of each of the sound emitters 3 when the sound-emitting surfaces 3S face each other (i.e. the position of the sound emitter 3 when the sound emitter 3 faces an ear of a user) in the exemplary embodiments. However, the invention is not limited thereto but the reference position is defined at other position(s) in some embodiments. Further, the sound emitter 3 is not necessarily rotatable from the reference position toward the rear side but toward the front side in some embodiments.

The boss 761 in the first and second exemplary embodiments is substantially cylindrical, and the boss 921 in the third and fourth exemplary embodiments is a substantially rectangular post with one pair of opposing corners being arc-shaped. However, the invention is not limited thereto but the bosses 761 and 921 are otherwise shaped (e.g. square column) in some embodiments. For instance, the boss 761 has the same shape as the boss 921 in some embodiments, and the boss 921 has the same shape as the boss 761 in some embodiments. It should be noted that the boss of the restricting member can be easily formed with the same shape as the boss 761. Alternatively, with the same shape as the boss 921, the cross sectional area of the boss can be easily enlarged without impairing slidability of the restricting member, thus easily enhancing the strength of the boss.

In the exemplary embodiments, the headphone includes the pair of sound emitters 3 and the pair of connectors 4 and 4A to 4C on the right and left of the headband 2. However, the invention is not limited thereto but the sound emitter and the connector are provided at only one of the right and left of the headband or, alternatively, only the connector of the headphone of the invention is provided at only one of the right and left of the headband in some exemplary embodiments.

The invention claimed is:

1. A headphone comprising:

a headband;

a sound emitter comprising a sound-emitting unit therein; and a connector connecting the sound emitter to the headband, wherein the connector comprises:

a support that supports the sound emitter so that the sound emitter is rotatable in a predetermined rotation range comprising a reference position;

a restoring portion configured to apply a restoring force on the sound emitter, the restoring force urging the sound emitter to return to the reference position; and a switcher configured to switch a state in which the restoring force acts on the sound emitter and a state in which the restoring force does not act on the sound emitter, the support comprises:

a connecting member connected to the sound emitter and engaged with a first end of the restoring portion; and a support member attached to the headband, the support member supporting the connecting member so that the connecting member is rotatable, the switcher comprises:

a piece member engaged with a second end of the restoring portion;

at least one restricting member configured to restrict a rotation of the piece member; and a drive member configured to move the restricting member to a restricting position at which the rotation of the piece member is restricted and an allowing position at which the rotation of the piece member is allowed, the restricting member is movable along a radial direction of the piece member, and the piece member comprises an abutment portion to be in contact with the restricting member when the restricting member is located at the restricting position.

2. The headphone according to claim 1, wherein the connector comprises a locking portion configured to lock the sound emitter at a predetermined rotation angle in the state in which the restoring force does not act on the sound emitter.

3. The headphone according to claim 1, wherein the drive member is an operation member configured to move the restricting member to one of the restricting position and the allowing position in response to an operation by a user.

4. The headphone according to claim 1, wherein the piece member comprises a rising portion standing on a surface of the piece member facing the restricting member, the restricting member is located inside the piece member with respect to the rising portion when the restricting member is located at the allowing position, and the restricting member is located outside the piece member with respect to the rising portion when the restricting member is located at the restricting position.

5. The headphone according to claim 4, wherein the abutment portion is defined by a peripheral edge of a cutout defined in the rising portion.

6. The headphone according to claim 1, wherein the support member comprises a guide configured to guide a movement of the restricting member, and the restricting member comprises an engagement portion penetrating through the guide to be engaged with the drive member.

7. The headphone according to claim 6, wherein the drive member is a dial, and the dial comprises a guide groove configured to receive the engagement portion in a form of a boss, the guide groove being configured to move the restricting member in the radial direction of the piece member in accordance with a rotation of the dial.

8. The headphone according to claim 7, wherein the switcher comprises an intermediate member rotatable in accordance with the rotation of the dial, and the intermediate member comprises a push portion configured to, when the dial is rotated, push the restricting member in a direction for the restricting member to be moved in accordance with the rotation of the dial.

9. The headphone according to claim 7, wherein the dial comprises a push portion configured to, when the dial is rotated, push the restricting member in a direction for the restricting member to be moved in accordance with the rotation of the dial.

10. The headphone according to claim 8, wherein the push portion has a curved profile so that the restricting member is moved in accordance with the rotation of the dial at substantially the same moving speed and in substantially the same direction as a moving speed and direction of a movement of the restricting member caused by the push portion.

11. The headphone according to claim 1, wherein the at least one restricting member comprises a plurality of restricting members provided across a rotation axis of the piece member.

12. The headphone according to claim 1, wherein the restoring portion comprises a torsion coil spring.

13. The headphone according to claim 9, wherein the push portion has a curved profile so that the restricting member is moved in accordance with the rotation of the dial at substantially the same moving speed and in substantially the same direction as a moving speed and direction of a movement of the restricting member caused by the push portion.

* * * * *